US007848682B2

(12) United States Patent
Tanaka

(10) Patent No.: US 7,848,682 B2
(45) Date of Patent: Dec. 7, 2010

(54) POWDER SUPPLIER AND IMAGE FORMING DEVICE

(75) Inventor: Hideaki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 842 days.

(21) Appl. No.: 11/636,468

(22) Filed: Dec. 11, 2006

(65) Prior Publication Data

US 2007/0264051 A1 Nov. 15, 2007

(30) Foreign Application Priority Data

May 10, 2006 (JP) ..... 2006-131823

(51) Int. Cl.
*G03G 15/08* (2006.01)

(52) U.S. Cl. ..... 399/254

(58) Field of Classification Search ..... 399/254–256, 399/258, 262, 263
See application file for complete search history.

(56) References Cited

U.S. PATENT DOCUMENTS

| | | | | |
|---|---|---|---|---|
| 5,491,537 | A | 2/1996 | Suzuki et al. | |
| 5,557,382 | A | 9/1996 | Tatsumi et al. | |
| 5,568,237 | A | 10/1996 | Ishida et al. | |
| 5,612,770 | A * | 3/1997 | Bandai et al. | 399/254 |
| 5,890,034 | A * | 3/1999 | Nakano et al. | 399/106 |
| 6,219,506 | B1 * | 4/2001 | Morinaga et al. | 399/109 |
| 6,385,422 | B1 * | 5/2002 | Ishiguro et al. | 399/258 |
| 6,456,810 | B1 * | 9/2002 | Deguchi et al. | 399/254 |
| 6,526,245 | B1 * | 2/2003 | Yamashita | 399/254 |
| 7,058,342 | B2 * | 6/2006 | Jeon | 399/254 |
| 7,209,685 | B2 * | 4/2007 | Oyama et al. | 399/254 |
| 7,532,844 | B2 * | 5/2009 | Tanaka | 399/254 |
| 7,561,835 | B2 * | 7/2009 | Tanaka et al. | 399/260 |
| 2006/0147228 | A1 | 7/2006 | Nagahama et al. | |
| 2007/0280739 | A1 * | 12/2007 | Tanaka | 399/254 |
| 2008/0279594 | A1 | 11/2008 | Sakoh et al. | |

FOREIGN PATENT DOCUMENTS

AU 2007-201530 A1 11/2007

(Continued)

OTHER PUBLICATIONS

U.S. Appl. No. 12/014,831, filed by Kiyoshi Sakoh on Jan. 16, 2008.

(Continued)

*Primary Examiner*—Robert Beatty
(74) *Attorney, Agent, or Firm*—Sughrue Mion, PLLC

(57) ABSTRACT

A powder supplier is provided. The supplier including: a non-cylindrical housing that stores a powder; a rotating member that is arranged rotatably inside the housing; a sheet-shaped conveying member that is fixed to the rotating member and has a free end side that differs from a fixed portion thereof, the sheet-shaped conveying member sweeping against inner walls of the housing due to rotation of the rotating member, and conveying the powder in an axial direction of the rotating member; a powder supply port provided in the housing at a downstream side of the direction in which the powder is conveyed; and an assisting member that is provided at a region of the conveying member opposite to the powder supply port and performs agitation of the powder and conveying of the powder to the powder supply port.

24 Claims, 13 Drawing Sheets

FOREIGN PATENT DOCUMENTS

| | | | | |
|---|---|---|---|---|
| CN | 1823307 | A | | 8/2006 |
| JP | 7-287448 | A | | 10/1995 |
| JP | 2000-003118 | A | | 1/2000 |
| JP | 2000250296 | A | * | 9/2000 |
| JP | 2001000501 | A | * | 1/2001 |
| JP | 2001100501 | A | * | 4/2001 |
| JP | 2001194887 | A | * | 7/2001 |
| JP | 2001-318517 | A | | 11/2001 |
| JP | 2002-006610 | A | | 1/2002 |
| JP | 2002006610 | A | * | 1/2002 |
| JP | 2002040786 | A | | 2/2002 |
| JP | 2002040788 | A | | 2/2002 |
| JP | 2002236410 | A | | 8/2002 |
| JP | 2002-287475 | A | | 10/2002 |
| JP | 2003-156927 | A | | 5/2003 |
| JP | 2003186294 | A | * | 7/2003 |
| JP | 2004-301975 | A | | 10/2004 |
| JP | 2005031299 | A | | 2/2005 |
| JP | 2005134817 | A | * | 5/2005 |
| JP | 2005-181366 | A | | 7/2005 |
| JP | 2007-034323 | A | | 2/2007 |

OTHER PUBLICATIONS

Australian Office Action dated Jul. 20, 2009.
Chinese Office Action dated Apr. 6, 2010.
Notification of Reason for Refusal issued Jun. 1, 2010 in Japanese Application No. 2007-122738.

* cited by examiner

POWDER SUPPLIER AND IMAGE FORMING DEVICE

BACKGROUND

1. Technical Field

The present invention relates to a powder supplier and a powder filling method where, inside a container in which a powder has accumulated, agitation of the powder is performed with the rotation of a rotating member such as an agitator and powder is conveyed to a powder supply port. The present invention also relates to an image forming device equipped with this powder supplier.

2. Related Art

Conventionally, image forming devices such as copiers and printers are widely used. These conventional devices are provided with: a photosensitive drum; a developing device that has a storage unit in which toner is stored and which sends out toner from a sending port provided in the front and supplies the toner to the photosensitive drum; a charging device; a transfer device that transfers toner to the paper; a cleaning device; and a fixing device that performs fixing to the paper.

The photosensitive drum, developing device, charging device, and cleaning device are unified and provided as a replaceable process cartridge.

An agitator is provided in the process cartridge. This agitator functions as an agitating-conveying means in which a toner agitating means and a toner conveying means are combined so that it agitates the toner in the storage unit and conveys the toner to a sending port.

Nonetheless, with this agitator, the shapes of the agitating wings of the sheet member are complicated, thereby making processing costs high. Further, conveyance in the radial direction of the agitator is limited by the circular shape of the bottom portion of the toner storage unit and to the region of the circular portion of the toner discharge port. Accordingly, it is necessary to make the toner container cylindrical and, when compared to a non-cylindrical toner container such as a substantially angular container, wasted space is created and it is thus difficult to make the device more compact.

SUMMARY

The first aspect of the present invention is a powder supplier including: a non-cylindrical housing that stores a powder; a rotating member that is arranged rotatably inside the housing; a sheet-shaped conveying member that is fixed to the rotating member and has a free end side that differs from a fixed portion thereof, the sheet-shaped conveying member sweeping against inner walls of the housing due to rotation of the rotating member, and conveying the powder in an axial direction of the rotating member; a powder supply port provided in the housing at a downstream side of the direction in which the powder is conveyed; and an assisting member that is provided at a region of the conveying member opposite to the powder supply port and performs agitation of the powder and conveying of the powder to the powder supply port.

BRIEF DESCRIPTION OF THE DRAWINGS

Exemplary embodiments of the present invention will be described in detail based on the following figures, wherein.

DETAILED DESCRIPTION

The powder supplier of the first exemplary embodiment and the image forming device will be explained based on the drawings.

Figure 1:
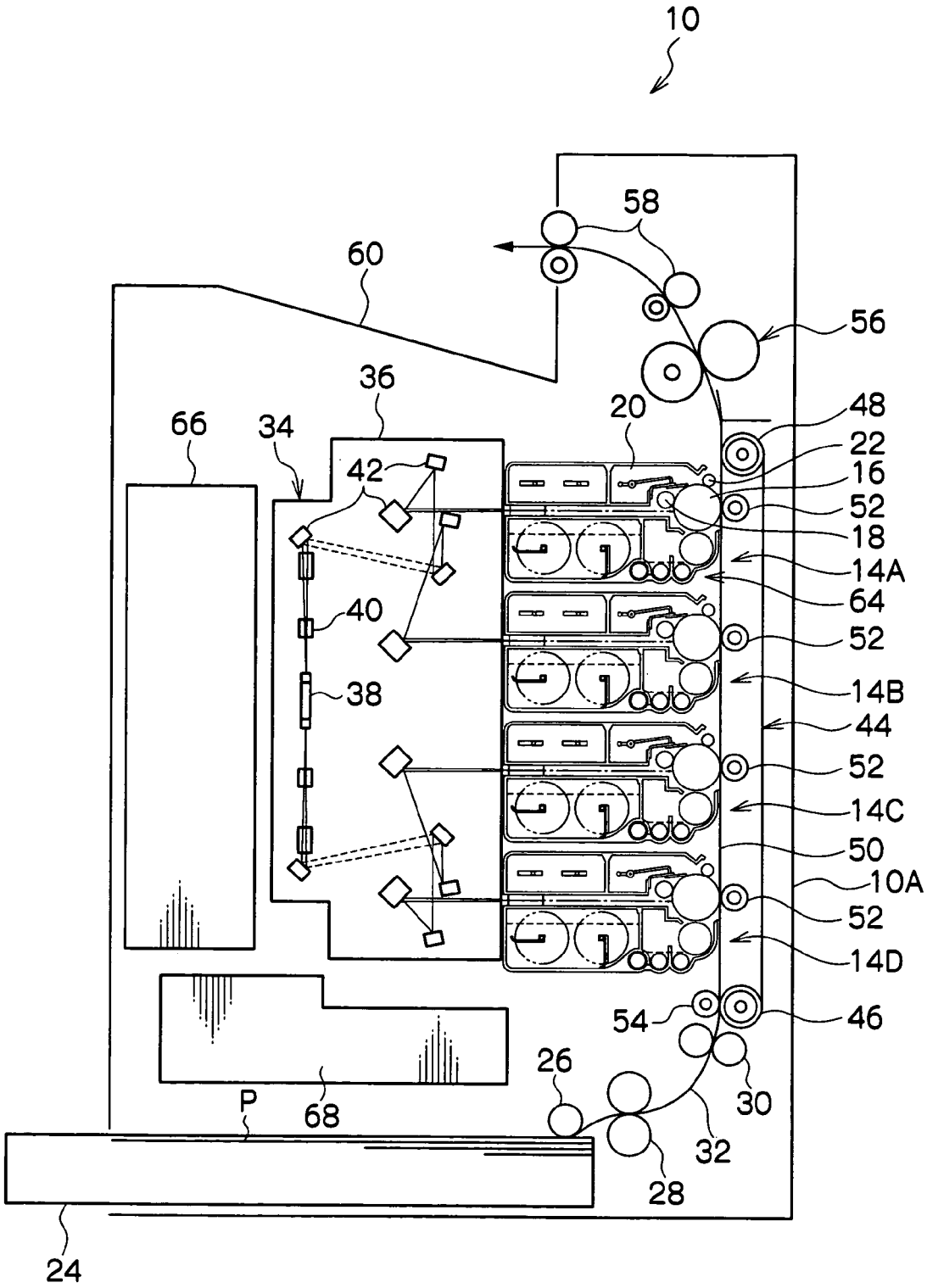
FIG. 1 is a cross-sectional view of a printer according to the first exemplary embodiment.

A printer 10 is shown in FIG. 1 as the image forming device of the first exemplary embodiment. A process cartridge 14 (14A (Y), 14B (M), 14C (C), and 14D (K)) that performs full color image formation with four colors of toner (yellow (Y), magenta (M), cyan (C), and black (K)) is disposed in the up and down direction in the printer 10. Each of the toners Y, M, C, and K are not limited to any particular method of production and various toners can be used.

As a method for preparing a toner, for example: a kneading and grinding method of kneading, grinding and classifying a binding resin, a colorant, a releasing agent and, further if necessary, a charge control agent; a method of changing a shape of the particle obtained by the kneading and grinding method with the mechanical impact force or the heat energy; an emulsion polymerizing method of emulsion-polymerizing a polymerizable monomer of a binding resin, mixing the formed dispersion, and a dispersion of a colorant, a releasing agent and, if necessary, a charge control agent, and aggregating and heating to melt to obtain a toner particle; a suspension polymerizing method of suspending a solution of a polymerizable monomer for obtaining a binding resin, a colorant, a releasing agent and, if necessary, a charge control agent in an aqueous solvent, followed by suspension; and a dissolving and suspending method of suspending a solution of a binding resin, a colorant, a releasing agent and, further if necessary, a charge control agent in an aqueous solvent, followed by granulation, and the like can be used.

Further, a toner obtained with one of the above-described methods can be made to act as the core, and any well-known method of production, such that aggregated particles are further adhered to the core and heat fused thereto, can be used to give it a core shell structure. Nonetheless, from the perspective of exercising control over form and grain distribution, it is preferable to use either a suspension polymerizing method, an emulsion polymerizing aggregation method, or a method involving dissolving and suspending (these methods produce through aqueous solvents). An emulsion polymerizing aggregation method is further preferable. The base material of the toner is made up from binding resins, colorants, and releasing agents and, if necessary, silica and charge control agents can also be used.

A toner base material with an average particle diameter of approximately 2 to 12 μm can be used, and it is preferable to use a toner with a particle diameter of approximately 3 to 9 μm. By using a toner where the average shape factor (ML2/A) is approximately 115 to 140, an image with high developing and transferring properties and high image quality can be obtained.

The average shape factor (ML2/A) indicates a value computed with the following formula, and in the case of a spherical shape, ML2/A=100.

$$ML2/A=(\text{maximum length})^2*\pi*100/(\text{area}*4)$$

A specific technique that can be used to determine the average shape factor is one where the toner image is inputted from an optical microscope into an image analyzer (Luzex III manufactured by Nireco Corporation), the circle suitability diameter is measured, and the value ML2/A of the above formula regarding each particle is determined from the maximum length and the area of the particles.

Examples of a binding resin to be used include homopolymers and copolymers such as styrenes such as styrene, chlorostyrene and the like; mono-olefins such as ethylene, propylene, butylene, isoprene and the like; vinyl esters such as vinyl acetate, vinyl propionate, vinyl benzoate, vinyl butyrate and the like; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate and the like, and vinyl ethers such as vinyl methyl ether, vinyl ethyl ether, vinyl butyl ether and the like; vinyl ketones such as vinyl methyl ketone, vinyl hexyl ketone, vinyl isopropenyl ketone and the like. Particularly, representative examples of a binding resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and the like.

Further examples include polyester, polyurethane, epoxy resin, silicone resin, polyamide, modified rosin, paraffin wax and the like.

Examples of the colorant include magnetic powder such as magnetite and ferrite, carbon black, aniline blue, calco oil blue, chrome yellow, ultramarine blue, DUPON oil red, quinolin yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, C.I. pigment blue 15:3.

Examples of the releasing agent include a low-molecular polyethylene, a low-molecular polypropylene, Fischer-Tropsch wax, Montand wax, carnauba wax, rice wax, and candelilla wax.

The charge controlling agent may be added to the toner in accordance with necessary. Although known charge controlling agents can be used, azo metal complex compounds, metal complex compounds of salicylic acid and resin type charge controlling agents having polar groups can be preferably used.

When the toner is manufactured according to a wet process, from viewpoints of controlling of ionic strengths and reduction of wastewater contamination owing to wastewater, materials which are difficult to dissolve in water may be used. The toner according to the invention may be either of a magnetic toner that includes a magnetic material or and a non-magnetic toner that does not include a magnetic material.

The toner that is used in the invention can be manufactured by mixing particles of the toner and external additives described below by using a Henshel mixer or a V-blender. Furthermore, when toner particles are manufactured according to a wet process, the external additives can be added during the wet process.

Examples of lubricating particles added (externally added) to the toner that is used in the invention include solid lubricants such as a graphite, molybdenum disulfide, talc, aliphatic acids or metal salts of aliphatic acids; low molecular weight polyolefins such as polypropylene, polyethylene or polybuthene; silicone compounds that are softened by heating; fatty-acid amides such as oleic acid amide, erucic acid amide, ricinoleic acid amide, or stearic acid amide; plant waxes such as carnauba wax, rice wax, candelila wax, crude Japan wax, or jojoba oil; animal waxes such as bees wax; mineral and petroleum type waxes such as montan wax, ozocerite, ceresine, paraffin wax, microcrystalline wax, or Fischer-Tropsch wax; and modified ones thereof. These may be used singly or in combinations thereof An average particle diameter of the lubricating particles is in a range of substantially about 0.1 to 10 μm, and ones having any of the above-exemplified chemical structures may be pulverized and arranged so as to have an average particle diameter that is within the above-described range. An amount that is added to the toner is preferably in a range of substantially about 0.05 to 2.0% by mass, and more preferably in a range of substantially about 0.1 to 1.5% by mass based on the amount of the toner.

In order to remove accretions and deteriorated materials on a surface of the electrophotographic photoreceptor, inorganic fine particles, organic fine particles, composite fine particles obtained by adhering inorganic fine particles to the organic fine particles, and the like can be added to the toner that is used in the invention. Among these, the inorganic fine particles, which are excellent in polishing property, are particularly preferable.

Examples of the inorganic fine particles include various kinds of inorganic oxides such as silica, alumina, titania, zirconia, barium titanate, aluminum titanate, strontium titanate, magnesium titanate, zinc oxide, chromium oxide, cerium oxide, antimony oxide, tungsten oxide, stannic oxide, tellurium oxide, manganese oxide, boron oxide, silicon carbide, boron carbide, titanium carbide, silicon nitride, titanium nitride or boron nitride; nitrides; and borides may be used.

The above-described inorganic fine particles may be treated with titanium coupling agents such as tetrabutyl titanate, tetraoctyl titanate, isopropyltriisostearoyl titanate, isopropyltridecylbenzenesulfonyl titanate, and bis(dioctylpyrophosphate)oxyacetate titanate; or silane coupling agents such as γ-(2-aminoethyl) aminopropyltrimethoxysilane, γ-(2-aminoethyl)aminopropylmethyldimethoxysilane, γ-methacrylloxypropyltrimethoxysilane, N-γ-(N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane or p-methylphenyltrimethoxysilane.

Furthermore, higher fatty acid metallic salts such as silicone oil, aluminum stearate, zinc stearate or calcium stearate can be applied to render hydrophobicity.

Examples of the organic fine particles include styrene resin particles, styrene-acrylic resin particles, polyester resin particles and urethane resin particles.

When the diameter of the particles is too small, the particles are deficient in polishing capability, and when the diameter of the particles is too large, scratches tend to occur on the surface of the electrophotographic photoreceptor. Accordingly, those having an average particle diameter in a range of substantially about 5 to 1000 nm, preferably in a range of about 5 to 800 nm, and more preferably in a range of about 5 to 700 nm are used. Further, it is preferable that a sum of an amount of these particles and the addition amount of the above-described lubricating particles is substantially about 0.6% by mass or more.

As other inorganic oxide that is added to the toner, a small diameter inorganic oxide having a primary particle diameter of about 40 nm or less is preferably added to improve a powder fluidity, and charge control and the like. Furthermore, an inorganic oxide that has larger diameter than that of the small diameter inorganic oxide can be added in order to reduce an adhesive power and to perform charge control.

Conventionally-known fine particles of inorganic oxides can be used as these inorganic oxides. Among them, in order to apply precise charge control, silica and titanium oxide are preferably used in combination. Furthermore, with regard to the small diameter inorganic particles, when the surface treatment is applied thereto, a dispersibility thereof can be enhanced, and as a result, an effect of improving a powder fluidity is enlarged.

Also, color toner used in electrophotography is mixed with a carrier and used. Iron powder, glass beads, ferrite powder, or nickel powder are used for the carrier, or alternately, these materials provided with a resin coating on their surfaces. Further, the mix ratio with the carrier can be set appropriately.

It is known that mild soft blocking is generated with each of the toners of the above-described substances, where the toner is aggregated due to heat and pressure at the time of filling of toner to the container.

Figure 2:
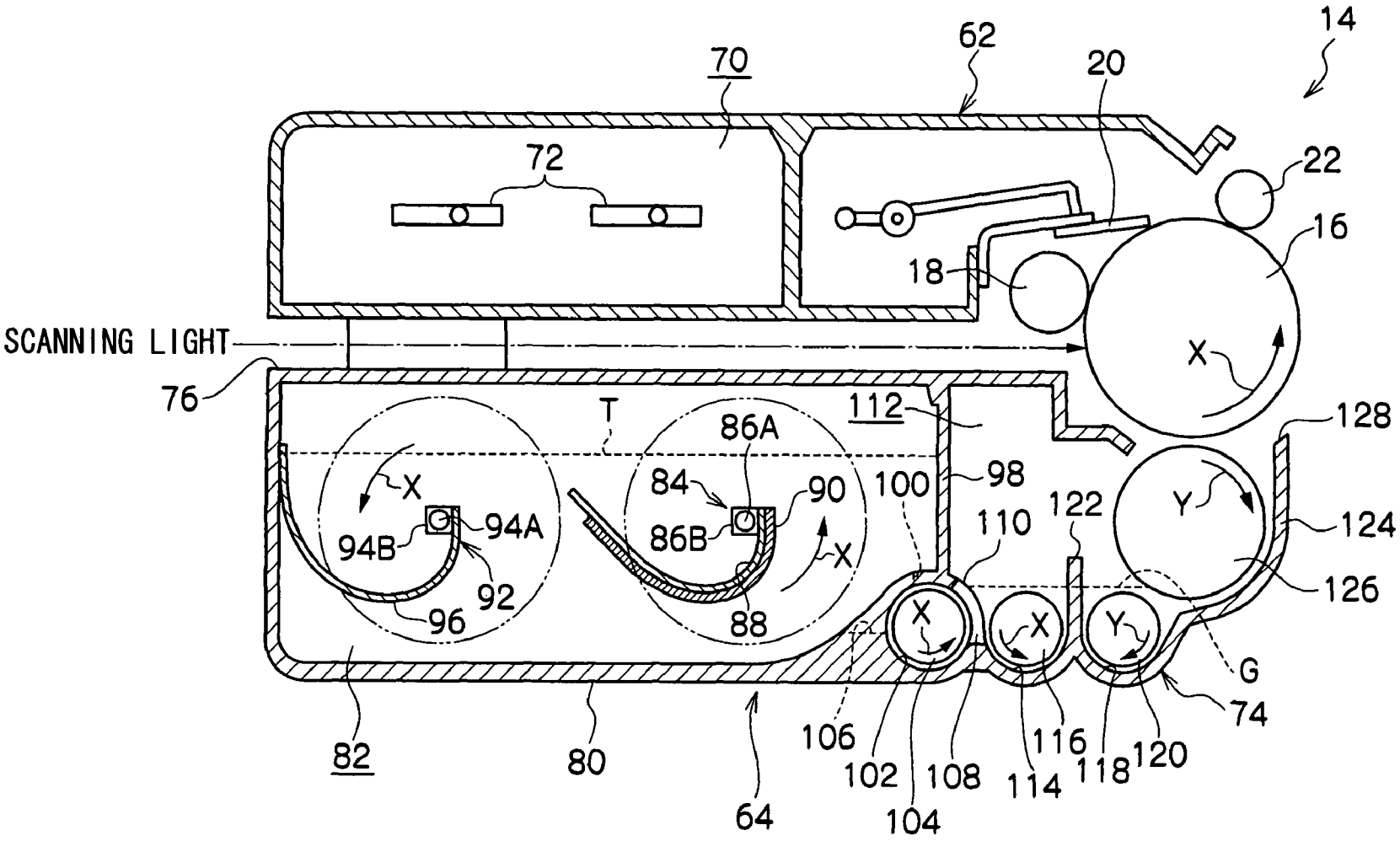
FIG. 2 is a cross-sectional view of a process cartridge according to the first exemplary embodiment.

Here, as shown in FIG. 2, the process cartridge 14 includes a developing device 64 and a photosensitive cartridge 62 having a photosensitive drum 16. Each color of toner is stored in the developing device 64, and development of each color of toner is performed for an electrostatic latent image formed in the photosensitive cartridge 62.

The photosensitive cartridge 62 is integrally formed with the photosensitive drum 16, as well as a charging roll 18, a cleaning device 20, and an erase lamp 22 arranged in the periphery of the photosensitive drum 16, and a sub-toner replenishing unit 70 arranged in the horizontal direction of the cleaning device 20.

An agitating-conveying member 72 that performs agitation and conveyance of the toner is provided in the sub-toner replenishing unit 70. A supporting protrusion (not shown) is also provided in the sub-toner replenishing unit 70. The device is designed so that the process cartridge 14 is attached to the printer 10 by making this supporting protrusion insert into a receiving portion (also not shown) on the printer 10.

As shown in FIG. 1, a paper supply cassette 24 in which paper P is stowed is provided in the lower portion of the printer 10. A pickup roll 26 that sends out the paper P at preset timing is provided in the vicinity of the paper supply cassette 24.

The paper P sent out from the paper supply cassette 24 by the pickup roll 26 is sent into a paper conveying path 32 via conveying rolls 28 and registration rolls 30, such that the paper P is conveyed to a conveying device 44 that conveys the paper P to the process cartridge 14.

The process cartridge 14 of colors Y, M, C, and K are arranged in this order from the upstream side of the paper conveying path 32. An exposing device 34 that irradiates scanning light to the process cartridge 14 is arranged to the left side of the drawing of the process cartridge 14.

A semiconductor laser (not shown), a polygon mirror 38, image forming lens 40, and mirrors 42 are arranged inside a case 36 of the exposing device 34. The light from the semiconductor laser is polarized and scanned with the polygon mirror 38 and irradiated to the photosensitive drum 16 via the image forming lens 40 and the mirror 42. Due to this, an electrostatic latent image is formed on the photosensitive drum 16 in accordance with image data.

The aforementioned conveying device 44 is arranged at the right side of the drawing of the printer 10 (i.e., at a position facing the photosensitive drum 16). The conveying device 44 includes a pair of tension rolls 46 and 48 provided along a side wall 10A of the printer 10 and a conveying belt 50 wound around these tension rolls 46 and 48. The tension roll 48 is configured to be rotated by a motor (not shown) so that the conveying belt 50 moves.

A adsorbing roll 54 is arranged in the vicinity of the tension roll 46. The paper P is adsorbed to the conveying belt 50 with static electricity due to voltage being applied to the adsorbing roll 54.

Further, transfer rolls 52 are arranged on the back surface of the conveying belt 50 at each position opposite to the photosensitive drum 16 of each color. The toner images on the photosensitive drums 16 are transferred by these transfer rolls 52 to the paper P conveyed by the conveying belt 50 and then fixed by a fixing device 56. Then the paper P on which the toner images are fixed is discharged to a discharge tray 60 by discharging rolls 58.

Next, the developing device 64 according to the first exemplary embodiment will be explained. A two-member development system is employed for the developing device 64 in the first exemplary embodiment.

As shown in FIG. 2, the developing device 64 is configured to be integrally formed with, in the horizontal direction, a developing unit 74 and a main toner replenishing unit 80 that supplies a toner T to this developing unit 74. The developing unit 74 is arranged opposite to the photosensitive drum 16, which is rotatable in the direction of the X arrow, and the electrostatic latent image on the photosensitive drum 16 is made into a visible image with a developer G, which is made from the toner and the carrier.

The developing unit 74 has a housing 124. The housing 124 is provided at the downward side of the photosensitive drum 16, and has an opening portion 128 that opens towards the photosensitive drum 16 side formed therein. A developer storage chamber 112 is also formed inside this housing 124. The developer G consisting of the toner and the carrier is stored inside this developer storage chamber 112.

Further, a developing roll 126 is arranged in the housing 124 so that a portion of the developing roll 126 is exposed from the opening portion 128 of the housing 124. The developing roll 126 is axially supported rotatably at the peripheral wall of the housing 124. A gear (not shown) is fixed at an end portion of the developing roll 126 and rotational force from a motor (not shown) is transmitted to the gear, whereby the developing roll 126 is rotatable in the Y direction via the gear.

The developing roll 126 adsorbs the carrier included in the developer G with magnetic force, forms a magnetic brush of developer G on the surface thereof, and conveys the toner adsorbed to the carrier to the development region facing the photosensitive drum 16. Then the electrostatic latent image formed on the photosensitive drum 16 is visualized into a visible image by the magnetic brush of developer G made up from carrier and toner formed on the surface of the developing roll 126.

A first agitating-conveying auger 120 and a second agitating-conveying auger 116 are arranged below the developing roll 126 along the axial direction of the developing roll 126.

Figure 4:
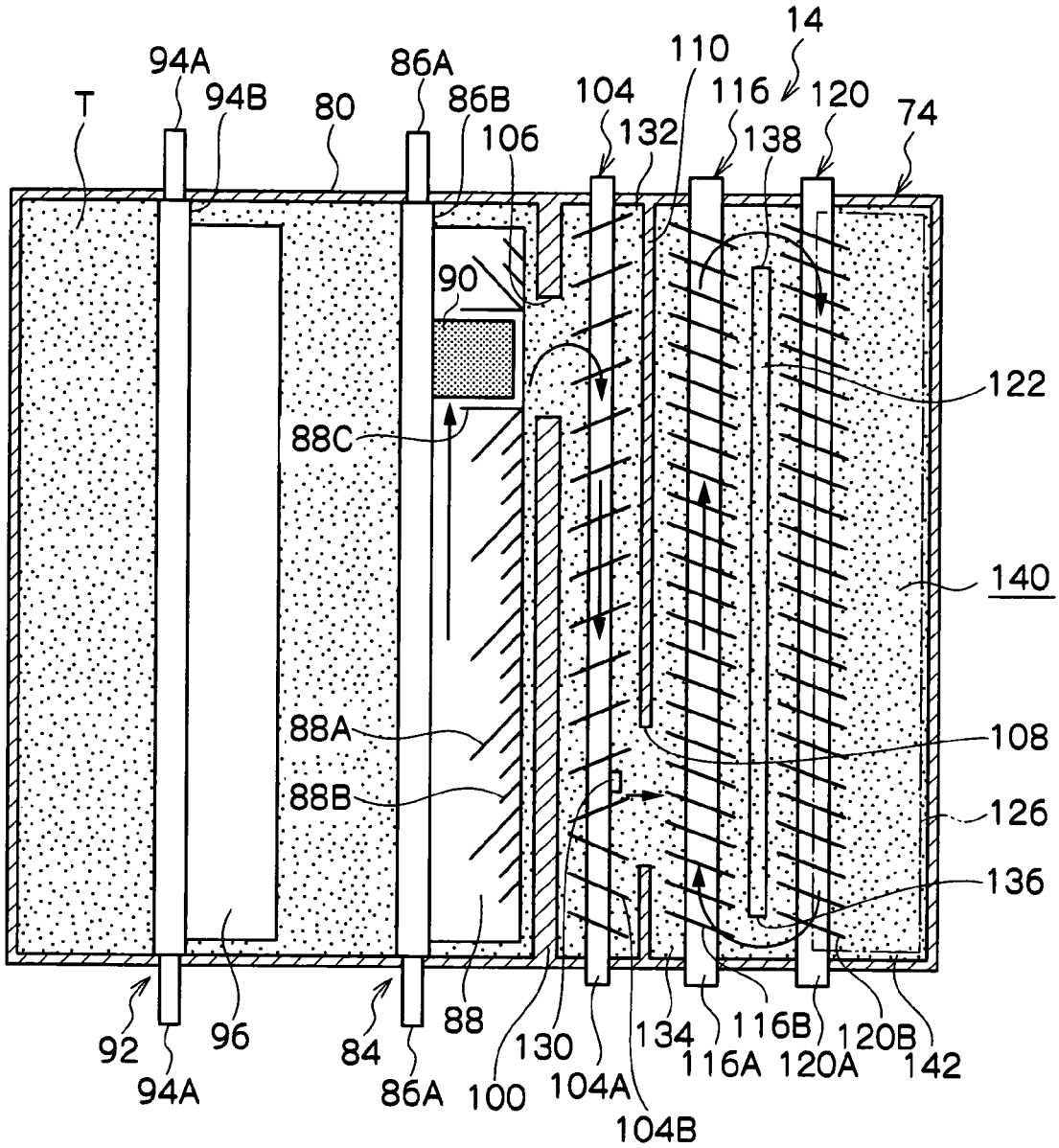
FIG. 4 is a cross-sectional view of a developing unit according to the first exemplary embodiment.

As shown in FIG. 4, the first agitating-conveying auger 120 and the second agitating-conveying auger 116 are respectively provided with rotation axes 120A, 116A, which are respectively axially supported so as to be rotatable at the peripheral wall of the housing 124. Spiral wings 120B, 116B are wrapped around, at a preset pitch, and formed in a spiral shape at the rotation axes 120A, 116A of the first agitating-conveying auger 120 and the second agitating-conveying auger 116.

Gears (not shown) are respectively fixed to the end portions of the rotation axes 120A, 116A. Rotational force from a motor (not shown) is transmitted to the gear, whereby the first agitating-conveying auger 120 and the second agitating-conveying auger 116 respectively rotate via the gears. Due to this, the developer G stored inside the developer storage chamber 112 is conveyed with the spiral wings 120B, 116B in the directions of the arrows in FIG. 4 while being agitated.

A first partition wall 122 is formed between the first agitating-conveying auger 120 and the second agitating-conveying auger 116. The inside of the developer storage chamber 112 is separated into two portions of a first agitation path 118 where the first agitating-conveying auger 120 is arranged and a second agitation path 114 where the second agitating-conveying auger 116 is arranged due to this first partition wall 122.

Linking ports 136 and 138 are formed at both end portions in the longitudinal direction of the first partition wall 122. The first agitation path 118 and the second agitation path 114 are in communication with each other due to these linking ports 136 and 138. The developer G inside the developer storage chamber 112 is conveyed, while being agitated, within each of the first agitation path 118 and the second agitation path 114 due to the rotation of the first agitating-conveying auger 120 and the second agitating-conveying auger 116, so that the developer G circulates between the first agitation path 118 and the second agitation path 114.

As shown in FIG. 2, a toner storage chamber 82 where replenishing toner T is stored is provided in the main toner replenishing unit 80 that is adjacent to the developing unit 74. A first agitator 84 and a second agitator 92 are provided in the toner storage chamber 82 along the axial direction of the developing roll 126.

A second partition wall 98, a curved wall 100, and a third partition wall 110 are provided between the toner storage chamber 82 and the developer storage chamber 112.

The curved wall 100 extends towards the toner storage chamber 82 side from the lower portion of the second partition wall 98 and the third partition wall 110 also extends towards the developer storage chamber 112 side, whereby a tunnel-shaped dispense chamber 102 is formed in the bottom portion of the housing 124. A dispense auger 104 that performs agitation and conveyance of toner in the longitudinal direction is provided inside the dispense chamber 102.

Here, as shown in FIGS. 2 and 4, a toner supply port 106 is formed in the vicinity of one end in the longitudinal direction of the curved wall 100 so as to connect the toner storage chamber 82 and the dispense chamber 102. Due to this, the toner T stored inside the toner storage chamber 82 is conveyed in the axial direction into the toner storage chamber 82 while being agitated by the first agitator 84 so that the toner is sent into the dispense chamber 102 from the toner supply port 106.

Meanwhile, an opening portion 108 is formed in the vicinity of the other end portion of the third partition wall 110 in the longitudinal direction so as to connect the dispense chamber 102 and the developer storage chamber 112. Due to this, the toner T inside the dispense chamber 102 is conveyed into the dispense chamber 102 while being agitated by the dispense auger 104 so that the toner is sent into the developer storage chamber 112 from the opening portion 108.

Also, as shown in FIG. 2, the lower end portion of the opening portion 108 is formed so as to be positioned lower than the surface position of the developer G stored in the developer storage chamber 112. Due to this, at least a portion of the opening portion 108 is in a state where it is sunk in the developer G stored in the developer storage chamber 112. For this reason, the toner T sent into the developer storage chamber 112 from the dispense chamber 102 sinks into the developer G, and it becomes easier to mix in with the developer G stored in the developer storage chamber 112.

The dispense auger 104 has substantially the same configuration as the first agitating-conveying auger 120 and the second agitating-conveying auger 116 and, as shown in FIG. 4, is provided with a rotation axis 104A that is axially and rotatably supported by a peripheral wall of the main toner replenishing unit 80. Wings 104B are wrapped around the rotation axis 104A in a spiral form at a preset pitch.

A gear (not shown) is fixed to an end portion of the rotation axis 104A. Rotational force from a motor (not shown) is transmitted to the gear, and when the dispense auger 104 rotates via the gear, the toner T inside the dispense chamber 102 is conveyed in the directions of the arrows in FIG. 4 by the wings 104B while being agitated.

A plate 130 is formed on the rotation axis 104A of the dispense auger 104 at a position facing the opening portion 108. The plate 130 protrudes in the diametric direction of the rotation axis 104A and is provided so that its lengthwise direction follows along the axis of the rotation axis 104A of the dispense auger 104.

Due to this, when the toner T conveyed into the dispense chamber 102 due to rotation of the dispense auger 104 reaches the position that faces the opening portion 108, the toner T is agitated by the wings 104B and simultaneously agitated by the plate 130 as well. Then, the toner T is supplied to the developer storage chamber 112 from the opening portion 108 while being agitated by the wings 104B and the plate 130.

As shown in FIG. 4, the first agitator 84 is provided with a first rotation axis 86A, a first support 86B, a first agitating-conveying film 88, and an assisting film 90, and the first agitator 84 is axially and rotatably supported at the peripheral walls of the main toner replenishing unit 80.

The second agitator 92 is provided with a second rotation axis 94A, a second support 94B, and a second agitating-conveying film 96, and is axially and rotatably supported at the peripheral walls of the main toner replenishing unit 80.

Figure 3A:
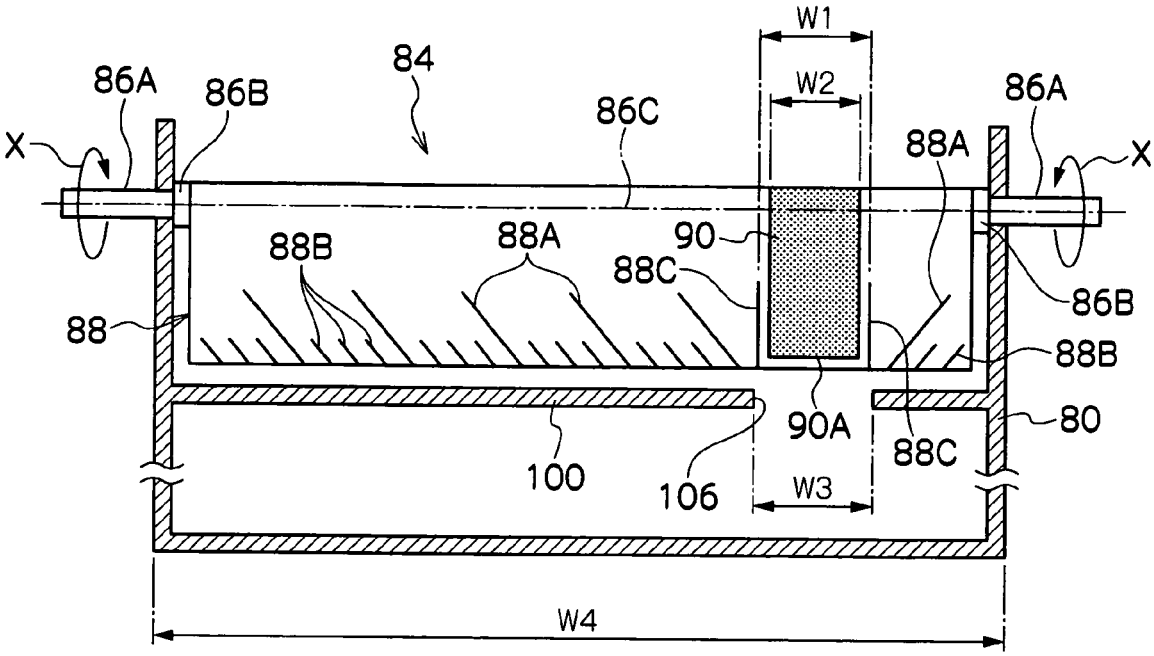
FIGS. 3A and 3B are cross-sectional views of an agitator according to the first exemplary embodiment.
Figure 3B:
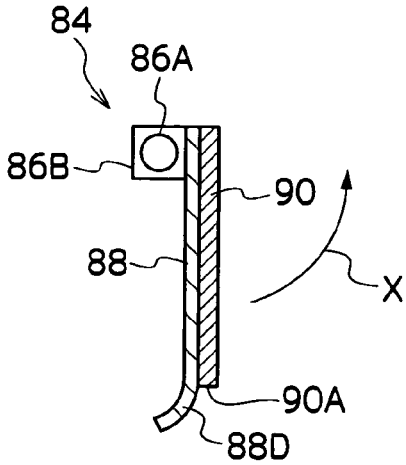

Here, as shown in FIGS. 3A to 3B, the first agitating-conveying film 88 extends in the axial direction of the first support 86B of the first agitator 84 and is sealed with adhesive and fixed to the first support 86B.

The first agitating-conveying film 88 is made from a flexible resin film such as PET and the like, and has first slits 88A, second slits 88B, and third slits 88C formed at an edge thereof.

The first slits 88A and the second slits 88B form substantially 45° angles with the axial direction of the first support 86B, and multiple of these are provided in the direction towards the toner supply port 106 from both end sides thereof The length of the first slit 88A is made to be longer than the length of the second slit 88B. Further, in the exemplary embodiment, three second slits 88B are provided between one pair of the first slits 88A.

A pair of the third slits 88C is provided at a position facing the toner supply port 106, which has a widthwise directional length W3. The third slits 88C are provided at both sides in the widthwise direction of the assisting film 90, which will be described later, with an interval of length W1. The cut direction of the third slits 88C is made to be the radial direction of rotation of the first support 86B.

Further, in the main toner replenishing unit 80, the length of the first rotation axis 86A in the axial direction is W4, and W1 is half or more the length of W3.

The assisting film 90 having a widthwise directional length W2 is provided in the area of the first agitating-conveying film 88 sandwiched by the pair of third slits 88C.

The assisting film 90 is made from a flexible resin film such as PET and the like and is layered on the first agitating-conveying film 88. One edge of the assisting film 90 is stuck to the first agitating-conveying film 88 and retained at the first support 86B. The other edge of the assisting film 90 becomes a free end 90A.

In the exemplary embodiment, the widthwise directions are provided so that W4 >W3>W1>W2.

The first rotation axis 86A and the second rotation axis 94A as shown in FIG. 4 have gears (not shown) fixed to their end portions. The rotational force of a motor (not shown) is transmitted to the gears, and when the first agitating-conveying film 88 and the second agitating-conveying film 96 rotate via the gears, the toner T inside the toner storage chamber 82 is conveyed in the directions of the arrows while being agitated.

Here, the lengths of the above W1, W3, and W4 will be explained.

Table 1 shows the results of evaluations of unevenness in toner conveyance when the opening width of the toner supply port 106 (W3) relative to the length of the main toner replenishing unit 80 (W4) in FIG. 3A is changed. Determination rankings of unevenness in toner conveyance are defined by changes in the amount of toner that passed the toner supply port 106 and is supplied to the opening portion 108 within a set period of time, and by evaluating the state of conveyance by sight.

TABLE 1

| Opening Width (W3)/Length of Housing (W4) | Unevenness in Toner Conveyance |
|---|---|
| 0.1 | A |
| 0.2 | A |
| 0.3 | A |
| 0.4 | A |
| 0.5 | B |
| 0.6 | C |
| 0.7 | D |
| 0.8 | D |
| 0.9 | D |
| 1.0 | D |

A: Little unevenness
B: Some unevenness
C: Unevenness somewhat great
D: Great unevenness As is shown in Table 1, when the ratio of the opening width (W3) of the toner supply port 106 relative to the length of the main toner replenishing unit 80 (W4) becomes 0.6 or more, it can be understood that unevenness in toner conveyance becomes great.

When there is great unevenness in the conveyance amount of toner, changes in the discharge amount of toner discharged at the developer storage chamber 112 side increase, and image density dispersion during image formation becomes large.

Further, when the width of the opening is wide, it becomes easier for toner (even the toner once taken in into the toner supply port) to return to the toner storage chamber 82 side again during conveyance in the toner supply port.

Accordingly, it is preferable that the ratio of the width of the opening (W3) of the toner supply port 106 relative to the length of the main toner replenishing unit 80 (W4) be approximately 0.5 or less.

However, because the overall amount of toner that is supplied reduces when the width of the toner supply port 106 is extremely narrow, it is preferable that the width of the opening (W3) even at its smallest be approximately 10 mm.

Next, Table 2 shows the results of evaluations (of the amount of toner conveyed) that are performed when the width (W1) between the pair of third slits 88C relative to the width of the opening (W3) of the toner supply port 106 in FIG. 3A is changed. Determination rankings of amount of toner conveyed were defined based on the amount of toner conveyed to the toner supply port 106, under stress conditions where soft blocking has been forcedly generated in the vicinity of the toner supply port 106.

TABLE 2

| Width of 3rd Slit (W1)/Width of Opening (W3) | Amount of Toner Conveyed |
|---|---|
| 0.1 | C |
| 0.2 | C |
| 0.3 | C |
| 0.4 | C |
| 0.5 | B |
| 0.6 | A |
| 0.7 | A |
| 0.8 | A |
| 0.9 | A |
| 1.0 | A |
| 1.1 | A |

A: Stable conveyance
B: Amount of toner conveyed at start of conveyance is somewhat small but stabilized thereafter
C: Soft blocking of toner cannot be completely broken through and amount of toner conveyed is small
D: Soft blocking of toner cannot be dissolved and toner cannot be conveyed As is shown in Table 2, when the ratio of the width (W1) between the third slits 88C relative to the width of the opening (W3) of the toner supply port 106 becomes 0.4 or less, it can be understood that the amount of toner that is conveyed decreases.

Accordingly, it is preferable that the ratio of the width (W1) between the third slits 88C relative to the width of the opening (W3) of the toner supply port 106 be approximately 0.5 or more.

Next, the operation of the first exemplary embodiment will be explained.

As shown in FIG. 2, when the first agitator 84 and the second agitator 92 are driven by a motor (not shown) and rotate in the X direction, load is applied upon the first agitating-conveying film 88 and the assisting film 90 from the toner T, and the first agitating-conveying film 88 and the assisting film 90 flex in the direction opposite to the X direction.

Next, the toner T inside the toner storage chamber 82 is agitated due to the rotational force of the first agitating-conveying film 88 and the assisting film 90 and due to the restoring strength of flexure. Furthermore, toner-conveying force toward the axial direction is generated due to differences in the way the first agitating-conveying film 88 flexes appearing in the vicinity of the first slits 88A. Similarly, toner-conveying force toward the axial direction is also generated in the vicinity of the second slits 88B.

Next, as shown in FIGS. 3A to 3B and FIG. 4, the toner T is conveyed up to the toner supply port 106 and supplied to the toner supply port 106 due to: the rotational force of the first agitating-conveying film 88 and assisting film 90; the elastic restoring force of the first agitating-conveying film 88 in the third slits 88C; and the elastic restoring force of the assisting film 90.

Next, the toner T supplied to the toner supply port 106 is sent into the dispense chamber 102. The toner T is conveyed to the opening portion 108 while being agitated inside the dispense chamber 102 with the dispense auger 104 in the dispense chamber 102.

The toner T conveyed to the opening portion 108 is supplied from the opening portion 108 to the developer storage chamber 112. The toner T is finely pulverized and broken up at the opening portion 108 with the plate 130.

The toner T supplied to the developer storage chamber 112 is mixed with the developer G and supplied to the developing roll 126.

As explained above, in the first exemplary embodiment, the capability of supplying the toner to the toner supply port 106 is improved due to the assisting film 90. For this reason, with the first exemplary embodiment, a simple configuration and low torque are achieved and further, stable toner conveyance can be realized.

Further, due to the improved toner-supplying capability, the amount of residual toner in the toner storage chamber 82 decreases and the waste of remaining toner can be reduced.

Also, only the region facing the toner supply port 106 has the assisting film 90 so that the stress imparted to the toner can be suppressed to its minimum, whereby grit and the like (where toner has aggregated with heat) is less likely to be generated.

In addition, compared to configurations such that the first agitating-conveying film 88 is made thick or two overlapping sheets are provided in the whole region thereof, noise from when rubbing against the inner walls of the toner storage chamber 82 can be reduced.

Further, the flexure of the first agitating-conveying film 88 is used to convey toner in the axial direction so that the toner can be conveyed using a simple configuration.

Furthermore, toner conveyance is performed primarily in the axial direction with the flexure formed by the first slits 88A, and the flexure formed by the second slits 88B supplements (i.e., assists) the toner conveyance of the first slits 88A. For this reason, a toner supplier with few parts and low cost can be obtained.

Even when, for example, there is a difference in levels in the inner wall of the toner storage chamber 82, deformations of the first agitating-conveying film 88 when contacting the difference in levels can be kept to a minimum due to the second slits 88B having small amount of cutting. For this reason, toner can be conveyed stably regardless of the form of the wall of the toner storage chamber 82.

Also, the toner-conveying force is improved due to the elastic restoring force of the assisting film 90.

The width of the toner supply port 106 is half or less that half the width of the main toner replenishing unit 80 so that unevenness in toner conveyance after the toner supply port 106 can be suppressed.

Due to the third slits 88C, not only is the toner-conveying force in the axial direction of the first agitating-conveying film 88 applied but also the toner-conveying force towards the toner supply port 106 is applied so that the toner-conveying force is even further improved. Also, the width between a pair of third slits 88C is a width that is half or more the width of the toner supply port 106, so that not only is the toner-conveying force in the axial direction applied, but the conveying force towards the toner supply port 106 is also applied and the toner-conveying force is even further improved. The toner of the inner side region of the third slits 88C is all conveyed in the direction of the rotational radius and it reaches the toner supply port 106 so that the device's ability to supply a powder is improved.

Also, the length of the assisting film 90 in the axial direction is shorter than the length between the third slits 88C of the first agitating-conveying film 88. For this reason, the toner conveying effect to the toner supply port 106 made possible by the third slits 88C of the first agitating-conveying film 88 is not hindered by the assisting film 90. The first agitating-conveying film 88 and the assisting film 90 can independently perform agitation and conveyance of the toner.

Further, since the region where two sheets of the first agitating-conveying film 88 and the assisting film 90 overlap is limited, noise generated when the first agitating-conveying film 88 is rotated due to rubbing against the inner wall of the toner storage chamber 82 can be suppressed.

Due to the above, toner conveyance unevenness in the printer 10 in the axial direction is reduced, the occurrence of image irregularities can be suppressed, and even images can be obtained.

Next, the second exemplary embodiment of the powder supplier will be explained based on the drawings. Note that parts that are essentially the same as those in the previously described first exemplary embodiment are provided with the same reference number as in the first exemplary embodiment, and explanations thereon will be omitted.

FIG. 5 and FIGS. 6A to 6C show examples where the form of the assisting film provided in the first agitator 84 (i.e., the assisting film 90 of FIG. 3) has been changed.

Figure 5:
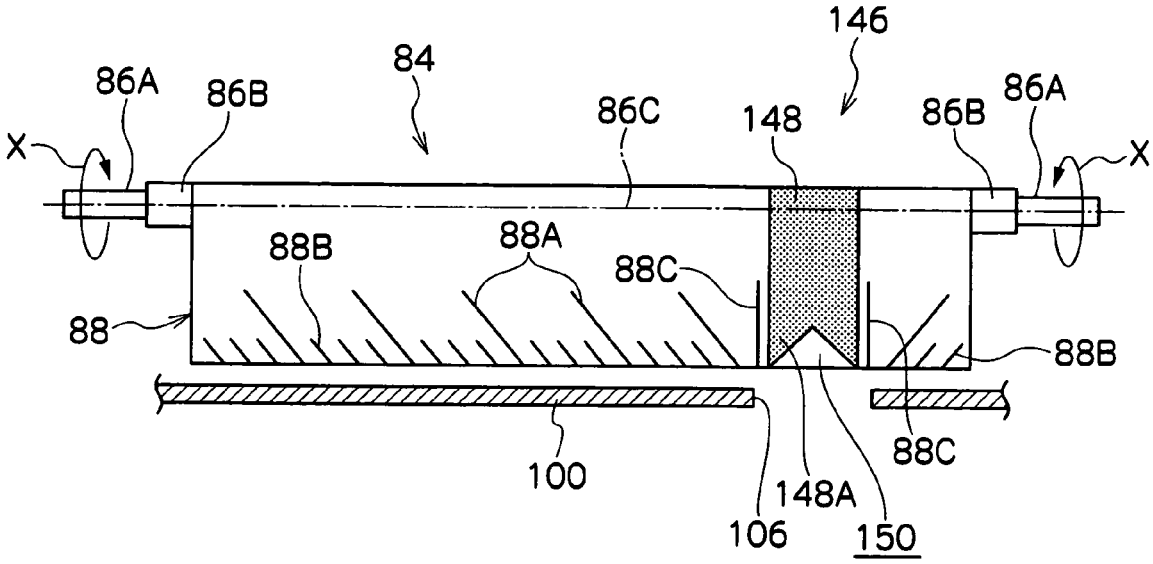
FIG. 5 is a plan view of an agitator according to the second exemplary embodiment.
Figure 6A:
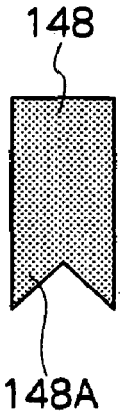
FIGS. 6A to 6C are plan views of supplementary film according to the second exemplary embodiment.

An assisting film 148 is shown in FIG. 6A, where the length of the central portion of the assisting film has been shortened and the lengths of both ends have been elongated. The assisting film 148 is made so that toner is supplied to the toner supply port 106 (see FIG. 5) due to the rotation of a free end 148A. Further, it is designed so that stress is not imparted to the toner in the inverted V-shaped region of the free end 148A.

Figure 6B:
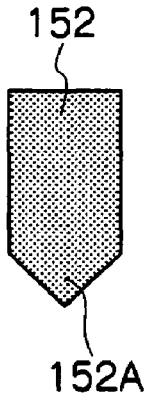

An assisting film 152 is shown in FIG. 6B, where the length of the central portion of the assisting film has been elongated and the lengths of both ends have been shortened. The assisting film 152 is made so that toner is supplied to the toner supply port 106 (see FIG. 5) due to the rotation of a free end 152A. Further, it is designed so that stress is not imparted to the toner in the regions at both sides of the V-shaped free end 152A and the toner is allowed to escape.

Figure 6C:
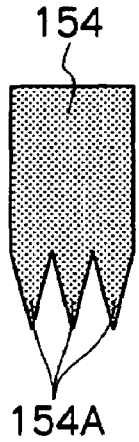

An assisting film 154 cut into multiple V-shapes is shown in FIG. 6C. The assisting film 154 is made so that toner is supplied to the toner supply port 106 (see FIG. 5) due to the rotation of a free end 154A. Further, it is designed so that stress is not imparted to the toner in the regions at both sides of the V-shapes of the free end 154A and the toner is allowed to escape.

Next, the operations of the second exemplary embodiment of the powder supplier will be explained.

In the case when the assisting film 148 is used, the load of toner is applied on the assisting film 148 due to the rotation of the first agitator 84 (see FIG. 5). Here, toner partially aggregates in the vicinity of the toner supply port 106 (see FIG. 5) due to effects from factors such as the filling of the toner or from the toner's own weight, and soft blocking thus becomes likely to occur. However, with the free end 148A of the assisting film 148, the region configured only by the first agitating-conveying film 88 (the region where the assisting film 148 is not overlapped with the first agitating-conveying film 88) becomes wider and undue stress is not imparted to the toner so that it is difficult for soft blocking to be generated. Note that at the side higher up than the inverted V-shaped region, two sheets, the first agitating-conveying film 88 and the assisting film 148 overlap so that the ability to convey toner is improved.

Next, when the assisting film 152 is used, load from the toner acts on the assisting film 152 due to the rotation of the first agitator 84 (see FIG. 5). Here, with the free end 152A of the assisting film 152, soft blocking of the toner is broken up at the V-shaped region of the central portion while toner is allowed to escape from both outer side of the V-shaped region.

Next, when the assisting film 154 is used, load from the toner acts on the assisting film 154 due to the rotation of the first agitator 84 (see FIG. 5). Here, the free end 154A of the assisting film 154 are formed into multiple mountain-shaped cuts so that the stress imparted to the toner in the vicinity of the toner supply port 106 is reduced and soft blocking of toner is broken through.

As explained above, in the second exemplary embodiment of the powder supplier, the form of the free edge of the assisting film is changed to various shapes.

The form of the free end 148A of the assisting film 148 is an inverted V-shape so that the stress imparted to the toner in the vicinity of the toner supply port 106 reduces, as does toner soft blocking, and stabilized powder conveyance can be performed.

Further, the form of the free end 152A of the assisting film 152 is a V-shape so that soft blocking of the toner in the vicinity of the toner supply port 106 can be broken up with the long portion in the center of the free end 152A. Furthermore, powder can be actively conveyed at the constant conveyance force of the long portion in the center of the free end 152A, while allowing powder to escape from both sides of the free end of the assisting film 152 in accordance with the load from the toner. Accordingly, conveyance of powder to the powder supplying port can be performed stably.

In addition, the form of the free end 154A of the assisting film 154 is formed into multiple mountain-shaped cuts. For this reason, the stress imparted to the toner in the vicinity of the toner supply port 106 is reduced, toner soft blocking is broken through, and a constant amount of toner can be conveyed to the toner supply port 106.

Next, the third exemplary embodiment of the powder supplier will be explained based on the drawings. Note that parts that are essentially the same as those in the previously described first exemplary embodiment are provided with the same reference number as in the first exemplary embodiment, and explanations thereon will be omitted.

Figure 7A:
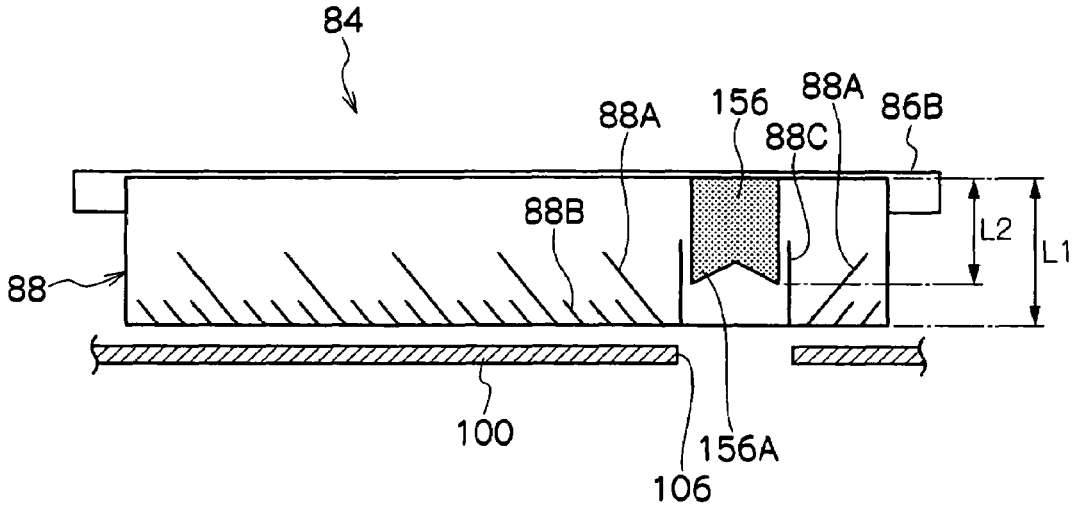
FIGS. 7A and 7B are plan views of an agitator according to the third exemplary embodiment.
Figure 7B:
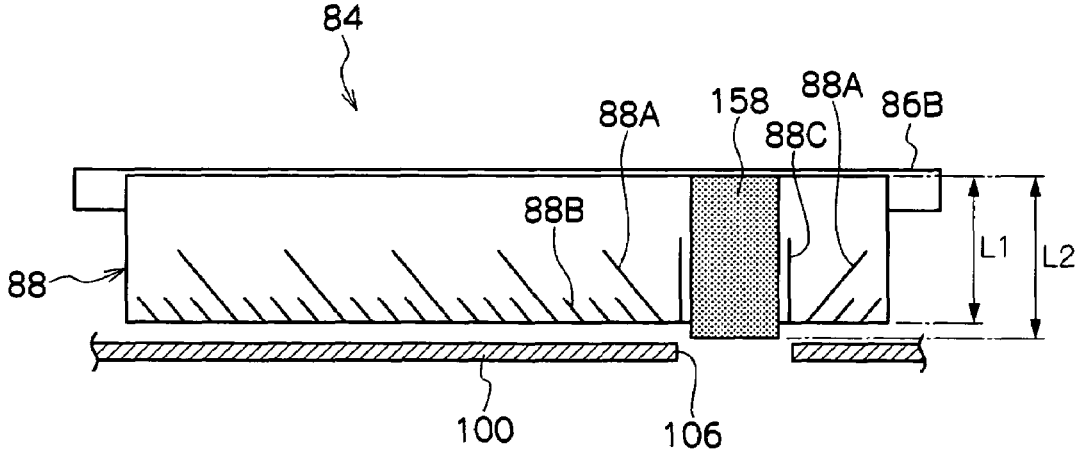

FIGS. 7A to 7B show examples where the shape of the assisting film provided at the first agitator 84 (i.e., the assisting film 90 of FIG. 3) and the length in the direction of the rotational radius have been changed.

An assisting film 156 is shown in FIG. 7A where the length of the central portion of the assisting film has been shortened and the length of both ends has been elongated, and the length (L2) of the direction of the rotational radius is shorter than the length (L1) of the direction of the rotational radius of the first agitating-conveying film 88. A portion of the toner is supplied to the toner supply port 106 with the region between the third slits 88C and with the absent region of the assisting film 156, due to the rotation of the first agitating-conveying film 88. In the region having the assisting film 156, a portion of the toner is conveyed to the toner supply port 106 and soft blocking is broken through due to a free end 156A. Further, the inverted V-shaped region of the free end 156A is made so that excessive stress is not imparted to the toner.

An assisting film 158 is shown in FIG. 7B where the length (L2) of the direction of the rotational radius of the assisting film is made longer than the length (L1) of the direction of the rotational radius of the first agitating-conveying film 88. A portion of the toner is supplied to the toner supply port 106 with the region between the pair of third slits 88C and where the assisting film 158 is not overlapped, due to the rotation of the first agitating-conveying film 88. In the region having the assisting film 158, the force for conveying the toner to the toner supply port 106 is increased by the free end 158A that protrudes out and due to the increased region where it overlaps with the first agitating-conveying film 88, the agitating force is also made to increase.

Next, the operations of the third exemplary embodiment of the powder supplier will be explained.

When using the assisting film 156, load from the toner is applied on the assisting film 156 due to the rotation of the first agitator 84 (see FIG. 5). Here, a portion of the toner is supplied to the toner supply port 106 with the region between the pair of third slits 88C and where the assisting film 156 is not overlapped, due to the rotation of the first agitating-conveying film 88.

Meanwhile, in the region of the assisting film 156 at the side close to the center of rotation, a portion of the toner is conveyed to the toner supply port 106 and soft blocking is broken through with the free end 156A. Also, undue stress is not imparted to the toner at the inverted V-shaped region of the free end 156A.

Also, when using the assisting film 158, load from the toner is applied on the assisting film 158 due to the rotation of the first agitator 84 (see FIG. 5). Here, the conveying force of the toner to the toner supply port 106 is increased due to the free end 158A that protrudes out long, and the agitating force of the toner also increases.

As was explained above, in the third exemplary embodiment when the assisting film 156 is used, the side close to the first support 86B of the first agitating-conveying film 88 exhibits improved powder-conveying force due to the assisting film 156. Further, the side that is far from the first support 86B only has the first agitating-conveying film 88 so that it contacts the toner softly and stress to the toner can be reduced. Furthermore, only the first agitating-conveying film 88 sweeps against the inner wall of the housing so that the generation of noise is suppressed.

When the assisting film 158 is used, the force for agitating the toner near the toner supply port 106 and the force for conveying the toner to the toner supply port 106 can be improved due to the free end 158A that protrudes out long.

Next, the fourth exemplary embodiment of the powder supplier will be explained based on the drawings. Note that parts that are essentially the same as those in the previously described first exemplary embodiment are provided with the same reference number as in the first exemplary embodiment, and explanations thereon will be omitted.

Figure 8A:
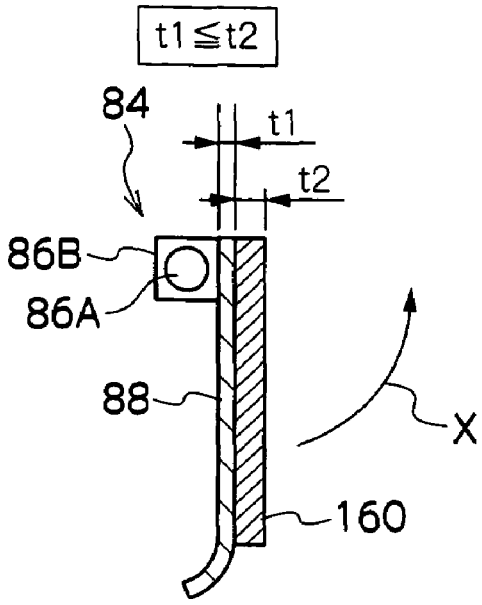
FIGS. 8A and 8B are cross-sectional views of an agitator according to the fourth exemplary embodiment.
Figure 8B:
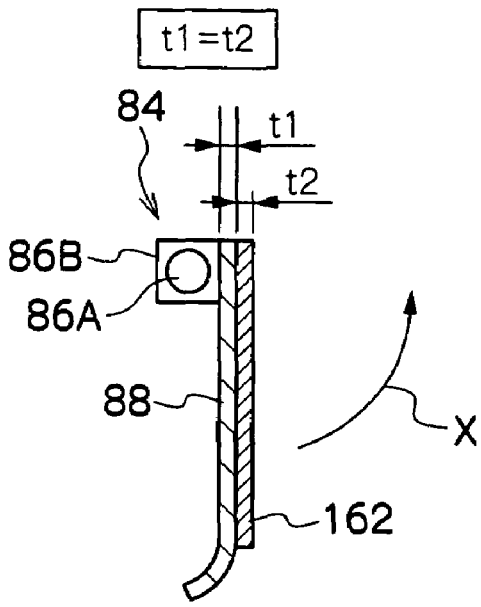

FIGS. 8A to 8B show examples where the thickness of the assisting film in the first agitator 84 (see FIG. 3) has been changed.

In FIG. 8A, an assisting film 160 is shown where the thickness of the assisting film is made thicker than then thickness of the first agitating-conveying film 88. By making the assisting film 160 thicker than the thickness of the first agitating-conveying film 88, the rigidity of the first agitator 84 (see FIG. 3) in the toner supply port 106 (see FIG. 3) is improved.

In FIG. 8B, an assisting film 162 is shown where the thickness of the assisting film is made equal to the thickness of the first agitating-conveying film 88. By making the assisting film 162 equal to the thickness of the first agitating-conveying film 88, this makes the toner-conveying ability of the first agitating-conveying film 88 and assisting film 162 equal.

Next, the operations of the fourth exemplary embodiment of the powder supplier will be explained.

When the assisting film 160 is used, load from the toner is applied upon the assisting film 160 due to rotation of the first agitator 84 (see FIG. 3). Here, since the assisting film 160 is thick and the rigidity of the first agitator 84 in the toner supply port 106 (see FIG. 3) is improved, the amount of toner supplied to the toner supply port 106 increases.

When the assisting film 162 is used, load from the toner is applied upon the assisting film 162 due to rotation of the first agitator 84. Here, the rigidities of the assisting film 162 and the first agitating-conveying film 88 are almost equal even if the assisting film 162 and the first agitating-conveying film 88 are rotated independently For this reason, the amount of toner supplied to the toner supply port 106 is stabilized.

As explained above, in the fourth exemplary embodiment, when the assisting film 160 is used, the rigidity of the region facing the toner supply port 106 rises, the ability to convey powder increases, and toner can be conveyed to the toner supply port 106 with certainty. Further, the area of the first agitator 84 where the rigidity is high is only the portion that faces the toner supply port 106. For this reason, noise can be reduced when the part of the first agitator 84 sweeps against the inner wall of the main toner replenishing unit 80 (see FIG. 2) and stress to the toner can also be reduced.

When the assisting film 162 is used, since the first agitating-conveying film 88 and the assisting film 162 posses similar abilities of supplying toner when the edges of the free end sides of first agitating-conveying film 88 and the assisting film 162 do not overlap and are rotated independently, supplying unevenness of the toner per rotation reduces.

Next, the fifth exemplary embodiment of the powder supplier will be explained based on the drawings. Note that parts that are essentially the same as those in the previously described first exemplary embodiment are provided with the same reference number as in the first exemplary embodiment, and explanations thereon will be omitted.

Figure 9:
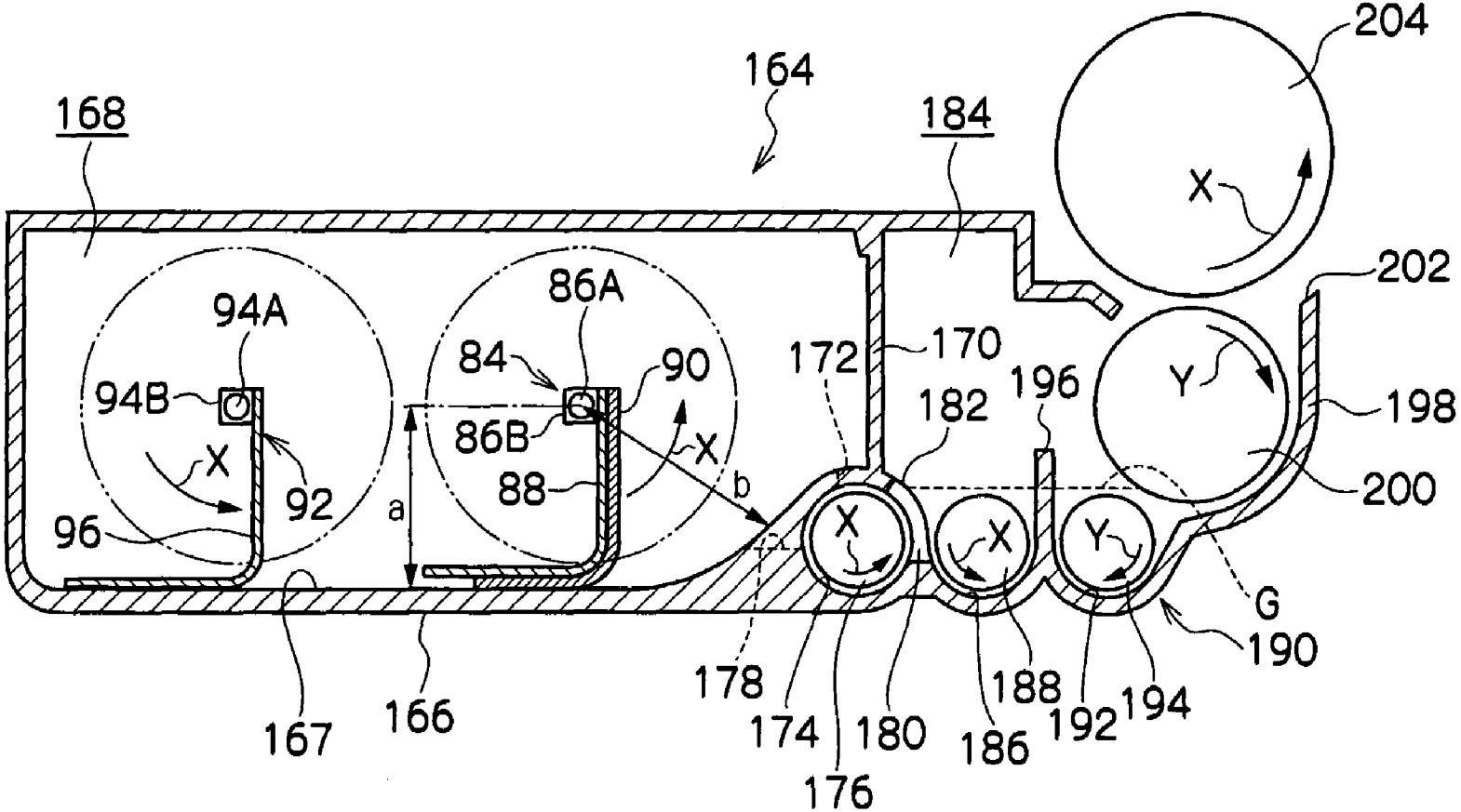
FIG. 9 is a cross-sectional view of a developing unit according to the fifth exemplary embodiment.

A developing device 164 prior to being filled with toner is shown in FIG. 9. The developing device 164 consists of a developing unit 190 and a main toner replenishing unit 166 that supplies toner to this developing unit 190 and these are provided integrally in the horizontal direction. The developing unit 190 is arranged so as to face a photosensitive drum 204 that is rotatable in the direction of the X arrow. The developing unit 190 makes the electrostatic latent image on the photosensitive drum 16 into a visible image with the developer G made from the toner and the carrier.

The developing unit 190 has a housing 198. The housing 198 is provided at the lower side of the photosensitive drum 204, and an opening portion 202 that faces and opens towards the photosensitive drum 204 side is formed. A developer storage chamber 184 is formed inside the housing 198 and developer G made from toner and carrier is stored inside this developer storage chamber 184.

Also, arranged in the housing 198 is a developing roll 200, a portion of which is exposed from the opening portion 202 of the housing 198. The developing roll 200 is axially supported rotatably at the peripheral walls of the housing 198. A gear (not shown) is fixed to the end portion of the developing roll 200. Rotational force from a motor (not shown) is transmitted to the gear, whereby the developing roll 200 is rotatable in the Y direction via the gear.

A first agitating-conveying auger 194 and second agitating-conveying auger 188 are arranged under the developing roll 200 along the axial direction thereof A first partition wall 196 is formed between the first agitating-conveying auger 194 and the second agitating-conveying auger 188. The developer storage chamber 18, is divided into two portions, a first agitation path 192 in which the first agitating-conveying auger 194 is arranged and a second agitation path 186 in which the second agitating-conveying auger 188 is arranged, with this first partition wall 196.

A toner storage chamber 168 in which replenishing toner is stored is provided in the main toner replenishing unit 166 that adjoins the developing unit 190. The first agitator 84 and the second agitator 92 are provided in the toner storage chamber 168 along the axial direction of the developing roll 200.

A second partition wall 170, a curved wall 172 and a third partition wall 182 are provided between the toner storage chamber 168 and the developer storage chamber 184.

The curved wall 172 extends towards the toner storage chamber 168 side from the bottom portion of the second partition wall 170, and the third partition wall 182 extends towards the developer storage chamber 184 side. Due to this configuration, the tunnel-shaped dispense chamber 174 is formed at the bottom of the housing 198. A dispense auger 176 that performs agitation and conveyance of the toner along the longitudinal direction is provided inside the dispense chamber 174.

Here, a toner supply port 178 is formed in the vicinity of one end in the longitudinal direction of the curved wall 172 so as to connect the toner storage chamber 168 and the dispense chamber 174. Due to this, the toner stored inside the toner storage chamber 168 is conveyed through the toner storage chamber 168 while being agitated with the first agitator 84 and the toner is sent into the dispense chamber 174 from the toner supply port 178.

The toner supply port 178 is provided in the area in the corner where the side wall and the bottom wall of the main toner replenishing unit 166 adjoin, and in the area out of the way of both ends in the axial direction of the first rotation axis 86A. The first agitating-conveying film 88 rotates, whereby toner T is conveyed from both end portions of the axial direction of the first rotation axis 86A towards the toner supply port 178.

An opening portion 180 is formed in the vicinity of the end portion of the other end of the second partition wall 170 in the longitudinal direction so as to link the dispense chamber 174 and the developer storage chamber 184. Due to this configuration, the toner inside the dispense chamber 174 is conveyed through the dispense chamber 174 while being agitated by the dispense auger 176, and is sent into the developer storage chamber 184 from the opening portion 180.

Also, the first agitator 84 is provided with the first rotation axis 86A, the first support 86B, the first agitating-conveying film 88, and the assisting film 90, and is axially and rotatably supported at the peripheral walls of the main toner replenishing unit 166. The free ends of the first agitating-conveying film 88 and the assisting film 90 are provided so as to be able to pass in front of the toner supply port 178.

The second agitator 92 is provided with the second rotation axis 94A, second support 94B, and the second agitating-conveying film 96, and is axially and rotatably supported at the peripheral walls of the main toner replenishing unit 166.

The first rotation axis 86A and the second rotation axis 94A are isolated from the bottom wall and the side walls of the main toner replenishing unit 166, and are provided at positions at a height in the central portion in the direction of the height of the side walls.

Here, the main toner replenishing unit 166 is formed in advance so that the shortest distance a from the center of rotation of the first rotation axis 86A to a bottom surface 167 of the toner storage chamber 168 is shorter than the shortest distance b from the center of rotation first rotation axis 86A to the toner supply port 178.

The main toner replenishing unit 166 is made into a substantially long flat rectangular shape so that the length of longitudinal direction of the bottom wall is longer than the length (i.e., the height) of the side wall.

Next, the operations of the fifth exemplary embodiment will be explained.

Toner is filled from a filling port (not shown) in the developing device 164 until it becomes an amount where the height is at the centers of rotation of the first rotation axis 86A and the second rotation axis 94A, or higher. Next, when toner is being supplied, the first agitator 84 and the second agitator 92 rotate in the direction of the X arrows.

With the rotation of the first agitator 84, the first agitating-conveying film 88 agitates the toner and conveys it in the axial direction, and toner is continuously accumulated in the vicinity of the toner supply port 178 from both ends in the axial direction, and toner is made to convey towards the toner supply port 178 with one of or both of the portion of the first agitating-conveying film 88 where is supplemented with the assisting film 90, and the assisting film 90*a*.

One or both of the tips of the first agitating-conveying film 88 and the assisting film 90 rotating in the direction of the X arrow and sweeping the bottom portion of the main toner replenishing unit 166 comes in contact with the toner supply port 178. However, the shortest distance b from the center of rotation of the first rotation axis 86A to the toner supply port 178 in the main toner replenishing unit 166 is longer than the shortest distance a from the center of rotation of the first rotation axis 86A to the bottom surface 167 of the toner storage chamber 168. For this reason, the portions of the first agitating-conveying film 88 and the assisting film 90 having strong rigidity cease to press strongly upon the vicinity of the toner supply port 178 and no stress more than necessary is applied upon the toner in the vicinity of the toner supply port 178. Hence, the toner is supplied to the toner supply port 178 in a loosened (i.e., non-compacted) state.

As explained above, in the fifth exemplary embodiment, the amount of toner filled continues to be maintained and stabilized supplying of toner can be performed, even if the developing device is one that is flat and substantially rectangular which can reduce wasted space in the printer 10 (see FIG. 1).

That is, toner is filled until it becomes an amount whose height is at least as high as the center of rotation of the first rotation axis 86A and the second rotation axis 96A, and the main toner replenishing unit 166 (i.e., the housing) was made to have the toner supply port 178 in the corner portion where the bottom wall and the side walls adjoin. For this reason, the amount of toner filled can be increased more than in a case where a cylindrical toner container is used. Also, the amount of toner filled can be sufficiently maintained and, even if the container is flat and rectangular, the amount of toner remaining at the bottom wall can be reduced due to the toner supply port 178 of the corner portion.

Further, by filling the toner to an amount where the height thereof is at least as high as the center of rotation of the first rotation axis 86A and the second rotation axis 96A, there are cases where the toner aggregates and hardens. This is due to the effects of tiny successive vibrations that occur such as during transport prior to the developing device actually used, or due to the effects of situations such as when the storage conditions are not good, e.g., the storage environment has high temperature and high humidity. Nonetheless, the free end of the first agitating-conveying film 88 where is supplemented with the assisting film 90, or the free end of the assisting film 90, are provided so as to be able to pass in front of the toner supply port 178 of the corner portion. For this reason, toner can be broken up with certainty and blocking of the toner supply port 178 can be prevented, even if it is in a corner portion where toner tends to aggregate and harden, and stable supplying of toner can be performed.

Further, even if it is the first agitating-conveying film 88 provided inside the flat rectangular main toner replenishing unit 166, deformations that accompany use can be lessened as much as possible. Then blockage of the toner supply port 178 provided in the corner portion can be continuously prevented and stabilized supplying of toner can be performed.

Also, by making the toner conveyed from both end portions of the axial direction towards the toner supply port 178, the toner density in the vicinity of the toner-supplying port can be raised and the pressure of the toner used so that blocking of the toner supply port 178 can be prevented while performing stable supplying of toner, even if the first agitating-conveying film 88 deforms with use, or even if the free end of the first agitating-conveying film 88 where is supplemented with the assisting film 90 or the free end of the assisting film 90 are distanced from in front of the toner supply port 178 of the corner portion.

Also, since the portion of the first agitator 84 that has high rigidity ceases to strongly press upon the vicinity of the toner supply port 178, stress on toner in the vicinity of the toner supply port 178 can be reduced.

Also, since the developing device 164 has a substantially angular form with corner portions, wasted installation space can be reduced, more than in the case of a cylindrical developing device, and a more compact developing device 164 can be realized.

Next, the sixth exemplary embodiment of the powder supplier will be explained based on the drawings. Note that parts that are essentially the same as those in the previously described first exemplary embodiment are provided with the same reference number as in the first exemplary embodiment, and explanations thereon will be omitted.

FIGS. 10A to 10D show examples where the positions of the first agitating-conveying film 88 and the assisting film 90 attached to the first support 86B have been changed.

Figure 10A:
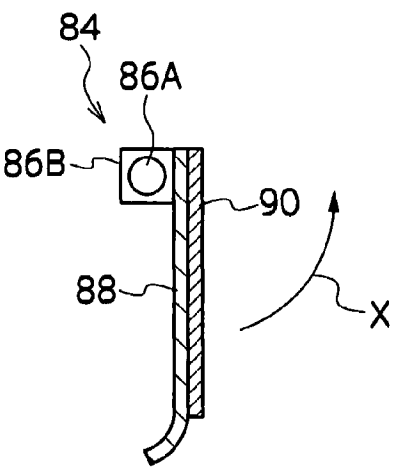
FIGS. 10A to 10D are cross-sectional views of an agitator according to the sixth exemplary embodiment.

The example in FIG. 10A is a mode similar to that of the first exemplary embodiment. The first agitating-conveying film 88 is attached to the first support 86B via adhesion and the assisting film 90 is adhered and attached on top of the first agitating-conveying film 88.

Figure 10B:
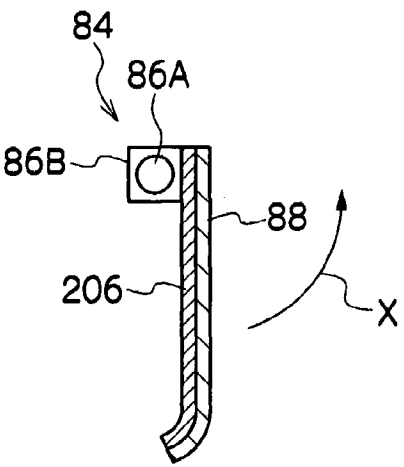

In the example of FIG. 10B, an assisting film 206 is attached to the first support 86B with adhesion and on top of that, the first agitating-conveying film 88 is adhered along the axial direction of the first support 86B and attached thereto.

Figure 10C:
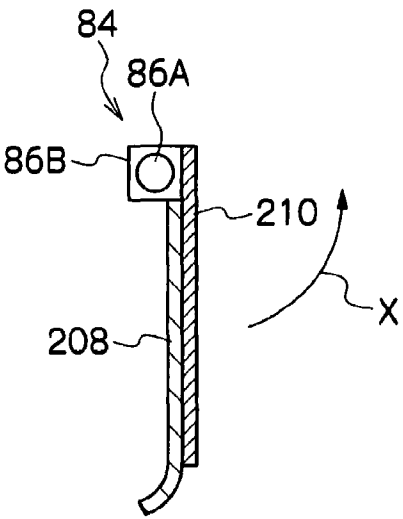

In the example of FIG. 10C, a first agitating-conveying film 208 is fixed to the first support 86B by being sandwiched, retained, and adhered by a cut (not shown) on the first support 86B, and an assisting film 210 is directly adhered to the first support 86B and attached thereto.

Figure 10D:
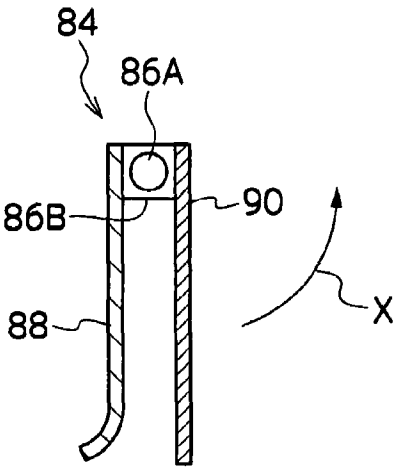

In the example of FIG. 10D, the first agitating-conveying film 88 is attached to one planar surface of the first support 86B via adhesion and the assisting film 90 is adhered and attached to the surface on the 180° opposite side of that planar surface.

Next, the operations of the sixth exemplary embodiment will be explained.

With the configuration of FIG. 10A, the first agitating-conveying film 88 rotates in a state where it supports a portion of the assisting film 90, due to the rotation of the first rotation axis 86A in the direction of the X arrow.

In the configuration of FIG. 10B, with the rotation of the first rotation axis 86A in the direction of the X arrow, the first agitating-conveying film 88 and the assisting film 206 each independently rotate.

In the configuration of FIG. 10C, with the rotation of the first rotation axis 86A in the direction of the X arrow, the first agitating-conveying film 208 rotates in a state where it supports a portion of the assisting film 210. Further, the assisting film 210 is directly stuck to the first support 86B and the strength of their attachment is improved.

In the configuration of FIG. 10D, the first agitating-conveying film 88 and the assisting film 90 each independently rotate with the rotation of the first rotation axis 86A in the direction of the X arrow. Here, while the amount of residual toner (not shown) is great, the toner is accumulated in the space between the first agitating-conveying film 88 and the assisting film 90, whereby the first agitating-conveying film 88 and the assisting film 90 rotate while maintaining their relative position relations.

As explained above, in the sixth exemplary embodiment, the first agitating-conveying film 88 having a large area is attached first to the first support 86B. For this reason, the assembling qualities are good and the adhesion strength is increased. Also, it is easy to closely contact the assisting film 90 to the first agitating-conveying film 88 so that the conveying force in the vicinity of the toner supply port 106 is stabilized. Further, in a case where the assisting film 90 is attached first to the first support 86B and the first agitating-conveying film 88 is attached over that, the freedom of the assisting film 90 at the time of rotation increases and the agitating force improves.

Next, the seventh exemplary embodiment of the powder supplier will be explained based on the drawings. Note that parts that are essentially the same as those in the previously described first exemplary embodiment are provided with the same reference number as in the first exemplary embodiment, and explanations thereon will be omitted.

Figure 11A:
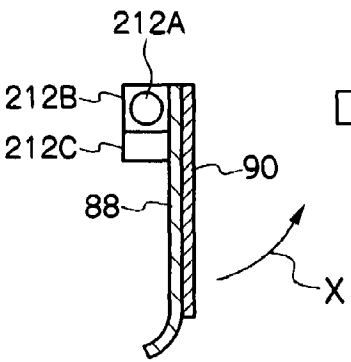
FIGS. 11A to 11C are plan views of an agitator according to the seventh exemplary embodiment.
Figure 11B:
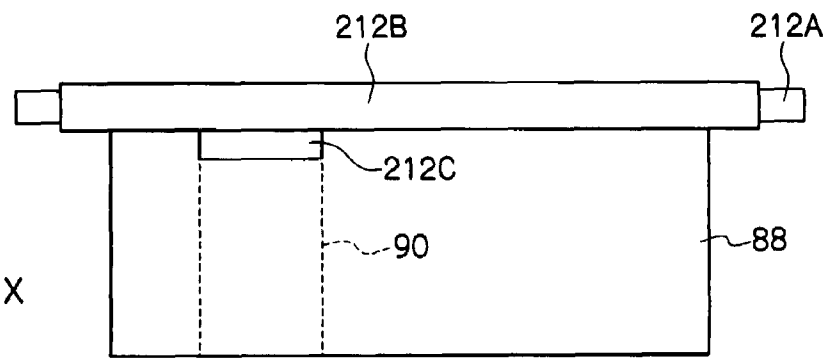

As shown in FIGS. 11A and 11B, a protrusion 212C is provided at a first support 212B having a first rotation axis 212A so as to protrude from one surface of the first support 212B, and to have a width that is substantially the same as the width of the assisting film 90. The protrusion 212C is provided at the downstream side of the first agitating-conveying film 88 in the direction of rotation of the X arrow, and it supports the first agitating-conveying film 88 and the assisting film 90.

Figure 11C:
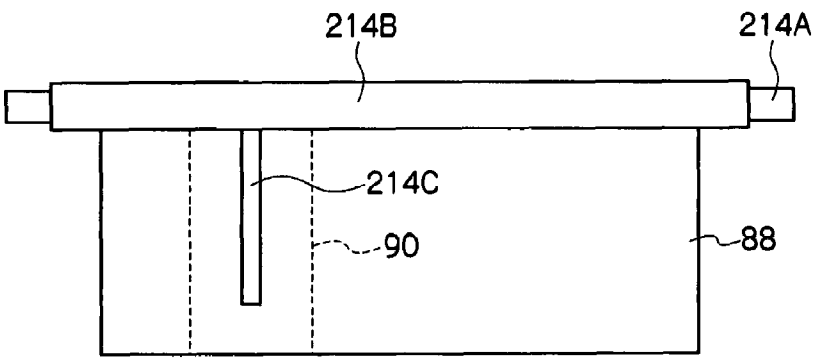

A protrusion 214C of FIG. 11C is an alternate example of the protrusion 212C and is formed long to protrude relative to the radial direction of rotation of the first rotation axis 212A.

Next, the operations of the seventh exemplary embodiment will be explained.

The first agitating-conveying film 88 and the assisting film 90 rotate in the direction of the X arrow due to the rotation of the first rotation axis 212A. Here, the first agitating-conveying film 88 and the assisting film 90 flex to the side opposite to the direction of rotation X due to pressure from the toner (not shown), however, they are supported by the protrusion 212C. For this reason, the strength and rigidity of the first agitating-conveying film 88 and assisting film 90 in the vicinity of the first rotation axis 212A improve so that even if the pressure from the toner is great, the toner conveying force and supplying force remain stable.

As explained above, in the seventh exemplary embodiment, the protrusion 212C (or the protrusion 214C) supports the first agitating-conveying film 88 and the assisting film 90, which receive pressure from the toner and warp, from the back surface and suppresses warping. For this reason, the agitating force and toner conveying force are not degraded and the toner conveying force is made stable.

Next, the first example of the method of using the powder supplier of the exemplary embodiments will be explained based on the drawings. Note that parts that are essentially the same as those in the previously described first exemplary embodiment are provided with the same reference number as in the first exemplary embodiment, and explanations thereon will be omitted.

Figure 12A:
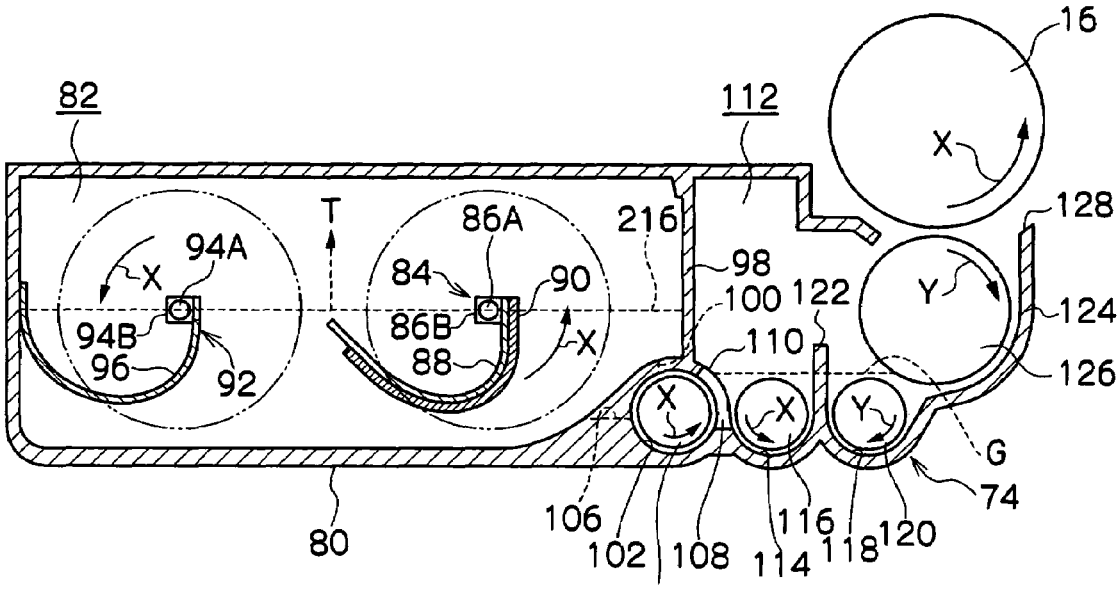
FIGS. 12A and 12B are cross-sectional views of a developing device according to a first method of use for the powder supplier of the exemplary embodiments.

As shown in FIG. 12A, toner T is filled into the main toner replenishing unit 80. A fill level 216 of the toner T (i.e., the height position of the upper surface) is at the position or higher of the center of rotation of the first rotation axis 86A and the second rotation axis 94A. Here, the fill level of the toner T is the fill level in a state during regular use. For example, prior to using the developing device, the toner T level is at a height in a state where the toner is sufficiently agitated and air has been included therein (or leaving it in that state, or in a settled state).

Next, the operation of the first method of use for the powder supplier will be explained.

Figure 12B:
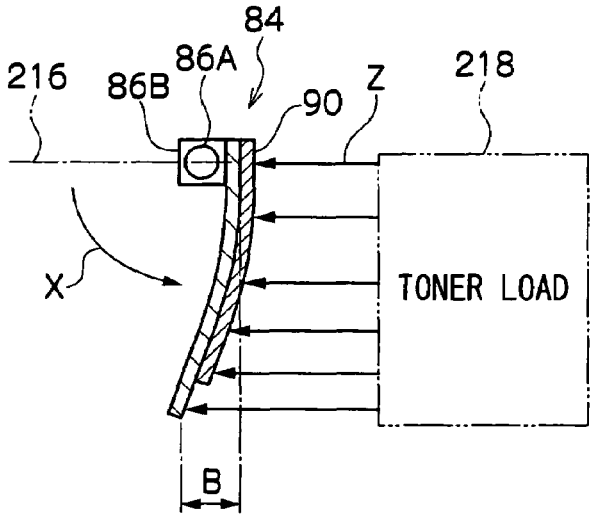

As shown in FIGS. 12A and 12B, a toner clump 218 inside the main toner replenishing unit 80 applies load on the first agitating-conveying film 88 and assisting film 90 in the direction of the Z arrow due to rotation of the first agitator 84 in the direction of the X arrow. The first agitating-conveying film 88 and the assisting film 90 rotate integrally in the direction of the X arrow due to toner load from the direction of the Z arrow.

Here, the fill level 216 of the toner T is at the position or higher of the center of rotation of the first rotation axis 86A and the second rotation axis 94A so that the first agitating-conveying film 88 and the assisting film 90 rotate as one until they have at least completed passing by the region in front of the toner supply port 106 in the main toner replenishing unit 80. Accordingly, the supplying of toner T to the toner supply port 106 is stable from the time of use of the main toner replenishing unit 80 has been initiated.

The less the amount of toner T filled, the freedom during film rotation increases, and it is easier for the first agitating-conveying film 88 and the assisting film 90 and the inner wall of the main toner replenishing unit 80, and/or the both tips of each of the films, to vigorously come into contact with each other, whereby noise is generated by due to the contacting and sweeping. However, with the present method, the amount of toner T filled is large from the start of use so that the generation of noise can be reduced.

As explained above, in the first method of use for the powder supplier, the position relationship between the first agitating-conveying film 88 and the assisting film 90 becomes constant. Thus, it is easy to stabilize the conveying of powder in the axial direction and conveying of toner to the toner supply port 106 from the beginning of use.

Further, since there is a great amount of toner at the time of initiation of use, the movement of the first agitating-conveying film 88 and assisting film 90 can be restricted and the vigor with which they contact the inner walls of the main toner replenishing unit 80 can be reduced. This also prevents friction between the films, and the toner acts as a shock-reducing material so that noise due to the first agitating-conveying film 88 and assisting film 90 sweeping against the inner wall can be reduced.

Next, the second method of using the powder supplier of the exemplary embodiments will be explained based on the drawings. Note that parts that are essentially the same as those in the previously described first exemplary embodiment are provided with the same reference numbers as in the first exemplary embodiment, and explanations thereon will be omitted.

Figure 13A:
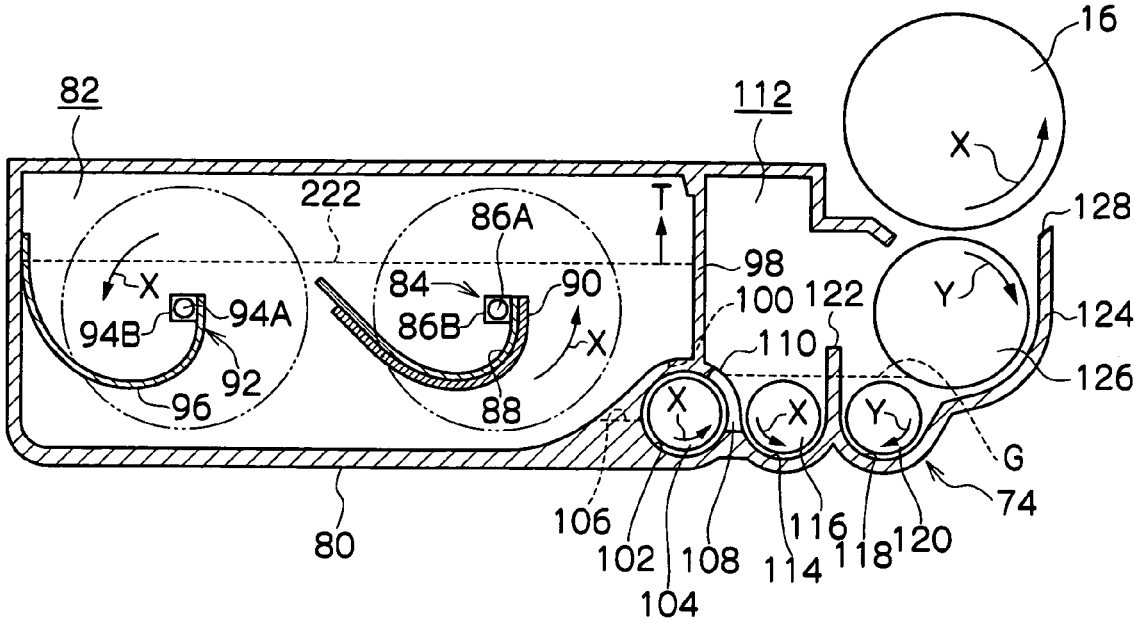
FIGS. 13A and 13B are cross-sectional views of a developing device according to a second method of use for the powder supplier of the exemplary embodiments.

As shown in FIG. 13A, toner T is filled into the main toner replenishing unit 80 at the time use is started. Here, the fill level for the toner T is the fill level in a state during normal use. For example, it is made to be a height in a state where the toner T has been sufficiently agitated with air included therein prior to use of the developing device (or, where it is left in that state and in a settled state).

Figure 13B:
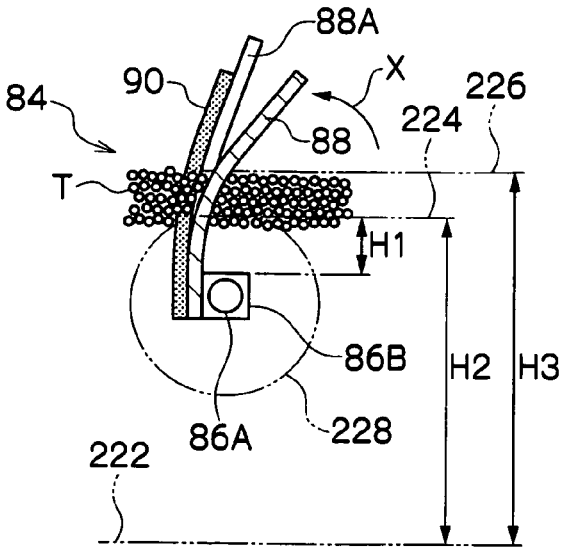

As shown in FIG. 13B, a first fill level 224 of the toner T is at a position separated by a distance (H2) from a bottom surface 222 of the main toner replenishing unit 80, and there is also a second fill level 226 of the toner T at a position separated by a distance (H3).

The distance H2 is a distance that is the sum of the distance from the bottom surface 222 of the main toner replenishing unit 80 to the upper surface of the first support 86B and the distance (H1) from the first support 86B to the root of the first slits 88A.

Here, the toner T is filled to the second fill level 226 so that the region from the center of rotation of the first rotation axis 86A to the ending of the first slits 88A of the first agitating-conveying film 88 is normally immersed.

Further, a passing region 228 where the width of H1 passes when the first agitator 84 rotates in the direction of the X arrow is shown in FIG. 13B. In the passing region 228, since there are no slits in the first agitating-conveying film 88, almost no toner is conveyed in the axial direction of rotation, and agitation and conveyance of toner is performed only in the radial direction of rotation.

Next, the operations of the second method of use for the powder supplier will be explained.

Load from the toner T is applied on the first agitating-conveying film 88 and assisting film 90 due to rotation of the first agitator 84 in the direction of the X arrow. The first agitating-conveying film 88 and assisting film 90 rotate as one in the direction of the X arrow due to the load from the toner T.

Here, the toner T is filled to the second fill level 226. For this reason, the toner T existing in the region between the distance H2 and the distance H3 is absolutely conveyed in the axial direction of the first rotation axis 86A due to the elastic restoring force of the first slits 88A, regardless of the rotation position from which rotation of the first agitating-conveying film 88 and the assisting film 90 is initiated.

Accordingly, the force for conveying the toner T in the axial direction is stable from the time when use of the main toner replenishing unit 80 is initiated.

As explained above, in the second method of use of the powder supplier, toner regularly exists in the slit portions when the first agitating-conveying film 88 rotates at the start of use. For this reason, toner conveyance in the axial direction can be performed stably from the time use is initiated, and powder can be stably conveyed to the toner supply port 106.

Note that the present invention is not limited to the above-described exemplary embodiments.

The printer 10 can be revolver-type device as long as the main toner replenishing unit 80 is arranged in a horizontal position. The position where the developing device 64 is set can be any position inside the printer 10.

The first support 86B can have a multi-angular prism form or a cylindrical form as well as a quadrangular prism form.

A sheet made of metal such as aluminum can be used for the first agitating-conveying film 88.

The angles of the first slits 88A and second slits 88B are not limited to approximately 45°, and these can be appropriately selected between 0 and 90° in accordance with the state of conveyance of the toner T.

Also, the angles of the first slits 88A and the second slits 88B can be provided so as to each be different angles.

The assisting film 90 can also be formed from multiple sheets that are divided. It can also be a conductive metal film that combines prevention of charging and with which removal of electricity by grounding is possible.

Also, the form of the assisting film 90 does not have to be one where the quadrangular forms and edges are sharp-angled, and a material with a circular arc form can also be used. With regard to the inverted V-shape as well, this can be formed to also have a circular arc shape.

Either one of the lengths of the first agitating-conveying film 88 and of the assisting film 90 in the radial direction of rotation can be made longer, or these can also be the same length.

Multiple protrusions 214C can be provided, e.g., a pair of protrusions 214C can be provided at each end of the assisting film 90 in the axial direction.

As explained in the third exemplary embodiment, the either one of the lengths of the first agitating-conveying film 88 and assisting film 90 can be made longer, or they can have the same length.

The forgoing description of the exemplary embodiments of the present invention has been provided for the purpose of illustration and description. It is not intended to be exhaustive or to limit the invention to the precise form disclosed herein. Obviously, many modifications and variations will be apparent to a practitioner skilled in the art. The exemplary embodiments were chosen and described in order to best explain the principles of the invention and its practical applications, thereby enabling others skilled in the art to understand the invention according to various embodiments and with various modifications as are suited to the particular use contemplated. It is intended that the scope of the invention be defined by the following claims and their equivalents.

What is claimed is:

1. A powder supplier comprising:

a non-cylindrical housing that stores a powder;

a rotating member that is arranged rotatably inside the housing;

a sheet-shaped conveying member that is fixed to the rotating member and has a free end side that differs from a fixed portion thereof, the sheet-shaped conveying member sweeping against inner walls of the housing due to rotation of the rotating member, and conveying the powder in an axial direction of the rotating member;

a powder supply port provided in the housing at a downstream side of the direction in which the powder is conveyed; and an assisting member that is provided at a region of the conveying member opposite to the powder supply port and performs agitation of the powder and conveying of the powder to the powder supply port, wherein the shortest distance from a center position of rotation of the rotating member to a bottom portion of the housing is shorter than the shortest distance from the center position of rotation of the rotating member to the powder supply port.

2. The powder supplier of claim 1, wherein the conveying member is formed of a flexible member.

3. The powder supplier of claim 2, wherein the conveying member comprises:

a plurality of first slits formed along the axial direction of the rotating member from a rotating member side of the conveying member to the free end, and formed in a slanted direction with respect to the powder supply port; and a plurality of second slits formed substantially in the same direction as the first slits, where an amount cut of the second slits is less than that of the first slits.

4. The powder supplier of claim 1, wherein the assisting member overlaps the conveying member and one end of the assisting member is fixed to the rotating member.

5. The powder supplier of claim 4, wherein the assisting member is formed of a flexible member.

6. The powder supplier of claim 1, wherein the width of an opening of the powder supply port is half or less than half the length of the housing.

7. The powder supplier of claim 1, wherein the conveying member comprises slits that are positioned at both sides of the assisting member and are formed in a direction perpendicular to the rotating member from the free end of the conveying member toward a rotating member side thereof.

8. The powder supplier of claim 7, wherein intervals between the third slits are half the width or larger than the width of an opening of the powder supply port.

9. The powder supplier of claim 4, wherein the shape of a free end of the assisting member is formed so that the center of the free end is long and becomes shorter towards both sides.

10. The powder supplier of claim 4, wherein the shape of a free end of the assisting member is formed so that both sides of the free end are long and the free end becomes shorter towards the center.

11. The powder supplier of claim 4, wherein the shape of a free end of the assisting member is formed with a plurality of mountain-shaped cuts.

12. The powder supplier of claim 1, wherein the length of the assisting member in the diametric direction of the rotating member is shorter than the length of the conveying member.

13. The powder supplier of claim 1, wherein the length of the assisting member in a diametric direction of the rotating member is longer than the length of the conveying member.

14. The powder supplier of claim 1, wherein the thickness of the assisting member is thicker than the thickness of the conveying member.

15. The powder supplier of claim 1, wherein the thickness of the assisting member is the same as the thickness of the conveying member.

16. The powder supplier of claim 1, wherein the conveying member and the assisting member are fixed to the rotating member so that the conveying member is positioned at an upstream side in a direction of rotation of the rotating member and the assisting member is positioned at a downstream side in the direction of rotation of the rotating member.

17. The powder supplier of claim 1, wherein the conveying member and the assisting member are fixed to the rotating member so that the assisting member is positioned at an upstream side in a direction of rotation of the rotating member and the conveying member is positioned at a downstream side in the direction of rotation of the rotating member.

18. The powder supplier of claim 1, wherein a region of the rotating member opposite to the powder supply port is provided with a protrusion that supports at least one of the conveying member and the assisting member.

19. An image forming device comprising the powder supplier according to claim 1.

20. A powder supplier comprising:

a housing that stores a powder;

a rotating member that is arranged rotatably inside the housing;

a sheet-shaped conveying member that is fixed to the rotating member and has a free end side that differs from a fixed portion thereof, the sheet-shaped conveying member sweeping against inner walls of the housing due to rotation of the rotating member, and conveying powder in an axial direction of the rotating member;

a powder supply port provided in the housing at a downstream side of the direction in which the powder is conveyed; and an assisting member that is provided at a region of the conveying member opposite to the powder supply port and performs agitation of the powder and conveying of the powder to the powder supply port, wherein the housing, when viewed from the axial direction of the rotating member, is formed in a flat substantially rectangular shape where the length in a longitudinal direction of a bottom wall of the housing is longer than the height of a side wall, is provided with the powder supply port in a corner portion where the bottom wall and the side wall adjoin, the rotating member is provided at a predetermined position separated from the bottom wall and the side wall, the powder is filled until the amount becomes such that a level thereof is at least as high as a center of rotation of the rotating member, and the free end of the sheet-shaped conveying member or a free end of the assisting member is provided so as to be able to pass in front of the powder supply port at the corner portion, wherein the shortest distance from a center position of rotation of the rotating member to a bottom portion of the housing is shorter than the shortest distance from the center position of rotation of the rotating member to the powder supply port.

21. The powder supplier of claim 20, wherein, when viewed from the axial direction of the rotating member, the housing is provided with the rotating member at a height of a center portion in a height direction of the side wall.

22. The powder supplier of claim 20, wherein the housing is provided with the powder supply port in a region excluding both ends in the axial direction of the rotating member, and the sheet-shaped conveying member conveys the powder from both ends in the axial direction of the rotating member towards the powder supply port.

23. An image forming device comprising the powder supplier according to claim 20.

24. A powder supplier comprising:

a non-cylindrical housing that stores a powder;

a rotating member that is arranged rotatably inside the housing;

a sheet-shaped conveying member that is fixed to the rotating member and has a free end side that differs from a fixed portion thereof, the sheet-shaped conveying member sweeping against inner walls of the housing due to rotation of the rotating member, and conveying the powder in an axial direction of the rotating member;

a powder supply port provided in the housing at a downstream side of the direction in which the powder is conveyed; and an assisting member that is provided at a region of the conveying member opposite to the powder supply port and performs agitation of the powder and conveying of the powder to the powder supply port, wherein the conveying member is formed of a flexible member, wherein the conveying member comprises:

a plurality of first slits formed along the axial direction of the rotating member from a rotating member side of the conveying member to the free end, and formed in a slanted direction with respect to the powder supply port; and a plurality of second slits formed substantially in the same direction as the first slits, where a length of cut of the second slits is less than a length of cut of the first slits.

* * * * *